US008570239B2

(12) United States Patent
Honda et al.

(10) Patent No.: US 8,570,239 B2
(45) Date of Patent: Oct. 29, 2013

(54) SPIRALING SURFACE ANTENNA

(75) Inventors: Royden M. Honda, Post Falls, ID (US); Robert J. Conley, Liberty Lake, WA (US)

(73) Assignee: LHC2 Inc., Liberty Lake, WA (US)

( * ) Notice: Subject to any disclaimer, the term of this patent is extended or adjusted under 35 U.S.C. 154(b) by 823 days.

(21) Appl. No.: 12/576,207

(22) Filed: Oct. 8, 2009

(65) Prior Publication Data

US 2010/0090924 A1 Apr. 15, 2010

Related U.S. Application Data

(60) Provisional application No. 61/104,633, filed on Oct. 10, 2008.

(51) Int. Cl.
*H01Q 1/36* (2006.01)
*H01Q 1/42* (2006.01)

(52) U.S. Cl.
USPC ..... 343/895; 343/872

(58) Field of Classification Search
USPC ..... 343/872, 895
See application file for complete search history.

(56) References Cited

U.S. PATENT DOCUMENTS

| | | | |
|---|---|---|---|
| 2,625,654 | A | 1/1953 | Alford |
| 2,812,514 | A | 11/1957 | Smith |
| 3,474,452 | A | 10/1969 | Bogner |
| 3,555,552 | A | 1/1971 | Alford |
| 3,618,114 | A | 11/1971 | Dietrich |
| 3,665,479 | A | 5/1972 | Silliman |
| 3,810,183 | A | 5/1974 | Krutsinger et al. |
| 4,131,892 | A | 12/1978 | Munson et al. |
| 4,204,212 | A | 5/1980 | Sindoris et al. |
| 4,233,607 | A | 11/1980 | Sanford et al. |
| 4,358,769 | A | 11/1982 | Tada et al. |
| 4,451,829 | A | 5/1984 | Stuckey, Jr. et al. |
| 4,527,163 | A | 7/1985 | Stanton |
| 4,546,459 | A | 10/1985 | Congdon |
| 4,613,868 | A | 9/1986 | Weiss |
| 4,710,775 | A | 12/1987 | Coe |
| 4,839,663 | A | 6/1989 | Kurtz |

(Continued)

FOREIGN PATENT DOCUMENTS

| | | |
|---|---|---|
| CN | 1147150 | 4/1997 |
| EP | 1959518 A2 | 8/2008 |

(Continued)

OTHER PUBLICATIONS

Brown, et al., "Circularly-Polarized Omnidirectional Antenna*" RCA Review, pp. 259-269, Jun. 1947.

(Continued)

*Primary Examiner* — Jacob Y Choi
*Assistant Examiner* — Amal Patel
(74) *Attorney, Agent, or Firm* — Lee & Hayes, PLLC

(57) ABSTRACT

Antennas that can transceive signals in a horizontally-polarized, omni-directional manner are described. In an example embodiment, an antenna comprises a spiraling surface having a spiral cross-section, the surface forming an internal cavity, an internal channel to the external surface, and an internal wall common to the cavity and the channel. Further, an example embodiment comprises a longitudinal opening allowing access to the cavity and the channel by a transmission feed line. Alternate embodiments comprise various cross-sectional configurations, and may also comprise a radome at least partially surrounding the antenna spiraling surface and supporting structure.

20 Claims, 16 Drawing Sheets

(56) References Cited

U.S. PATENT DOCUMENTS

| | | | | |
|---|---|---|---|---|
| 4,899,165 | A | 2/1990 | Schadler | |
| 4,907,008 | A | 3/1990 | Dienes | |
| 5,021,797 | A | 6/1991 | Dienes | |
| 5,105,199 | A | 4/1992 | Ukmar | |
| 5,426,439 | A | 6/1995 | Grossman | |
| 5,617,105 | A | 4/1997 | Tsunekawa et al. | |
| 5,870,061 | A | 2/1999 | Casciola et al. | |
| 5,877,729 | A | 3/1999 | Holloway et al. | |
| 5,955,997 | A | 9/1999 | Ho et al. | |
| 6,127,983 | A | 10/2000 | Rivera et al. | |
| 6,313,806 | B1 | 11/2001 | Schadler | |
| 6,384,794 | B1 * | 5/2002 | Huang | 343/767 |
| 6,414,647 | B1 | 7/2002 | Lee | |
| 6,456,243 | B1 * | 9/2002 | Poilasne et al. | 343/700 MS |
| 6,567,053 | B1 | 5/2003 | Yablonovitch et al. | |
| 6,593,892 | B2 | 7/2003 | Honda et al. | |
| 6,675,461 | B1 * | 1/2004 | Rowson et al. | 29/600 |
| 6,897,822 | B2 | 5/2005 | Sparks et al. | |
| 6,967,625 | B1 | 11/2005 | Honda | |
| 6,995,725 | B1 | 2/2006 | Honda et al. | |
| 7,006,052 | B2 * | 2/2006 | Delgado et al. | 343/872 |
| 7,256,750 | B1 | 8/2007 | Honda | |
| 7,394,435 | B1 | 7/2008 | Tavassoli Hozouri | |
| 2005/0012673 | A1 | 1/2005 | Parsche et al. | |
| 2006/0055605 | A1 * | 3/2006 | Peled et al. | 343/702 |
| 2010/0090924 | A1 | 4/2010 | Honda et al. | |
| 2010/0289716 | A1 | 11/2010 | Lenzi et al. | |

FOREIGN PATENT DOCUMENTS

| | | | |
|---|---|---|---|
| JP | 2001352210 | A | 12/2001 |
| WO | WO0249147 | A3 | 6/2002 |
| WO | WO02065583 | A1 | 8/2002 |

OTHER PUBLICATIONS

Carver, et al., "Microstrip Antenna Technology", IEEE Transactions on Antennas and Propagation, vol. AP-29, No. 1, Jan. 1981.

DeJean, Design of Compact Antennas in Multilayer Technology for Wireless Communications / WLAN Applications, A Thesis Presented to the Academic Faculty, Georgia Institute of Technology, Dec. 2, 2004.

Krall, et al., "The Omni Microstrip Antenna: A new Small Antenna", IEEE Transactions on Antennas and Propagation, vol. AP-27, No. 6, Nov. 1979.

Munson, "Conformal Microstrip Antennas and Microstrip Phased Arrays", IEEE Transactions on Antennas and Propagation, Jan. 1974.

The Extended European Search Report mailed Apr. 25, 2012 for European patent application No. 09819971.4, 8 pages.

The European Office Action mailed Jun. 28, 2013 for European patent application No. 09819971.4, a counterpart foreign application of U.S. Appl. No. 12/576,207, 5 pages.

Translated Chinese Office Action mailed Apr. 26, 2013 for Chinese patent application No. 200980140560.4, a counterpart foreign application of U.S. Appl. No. 12/576,207, 19 pages.

* cited by examiner

| Name | Theta | Ang | Mag |
|---|---|---|---|
| m1 | -32.0000 | -32.0000 | 9.5533 |
| m2 | -143.0000 | -143.0000 | 7.1009 |

| Name | Theta | Ang | Mag |
|---|---|---|---|
| m1 | -60.0000 | -60.0000 | 7.8309 |
| m2 | 47.0000 | 47.0000 | 6.3132 |

SPIRALING SURFACE ANTENNA

This patent application claims the benefit of U.S. Provisional Application Ser. No. 61/104,633, filed Oct. 10, 2008, the disclosure of which is incorporated by reference herein.

BACKGROUND

Wireless communication has become an integral part of modern life in personal and professional realms. It is used for voice, data, and other types of communication. Wireless communication is also used in military and emergency response applications. Communications that are made wirelessly rely on the electromagnetic spectrum as the carrier medium. Unfortunately, the electromagnetic spectrum is a limited resource.

Although the electromagnetic spectrum spans a wide range of frequencies, only certain frequency bands are applicable for certain uses due to their physical nature and/or due to governmental restrictions. Moreover, the use of the electromagnetic spectrum for wireless communications is so pervasive that many, if not most, frequency bands are already over-crowded. This crowding may cause interference between and among different wireless communication systems.

Such interference jeopardizes successful transmission and reception of wireless communications that are important to many different aspects of modern society. Wireless communication interference can necessitate retransmissions, cause the use of ever greater power outlays, or even completely prevent some wireless communications. Consequently, there is a need to wirelessly communicate with reduced electromagnetic interference that may hinder the successful communication of information. Use of horizontal polarization may improve communications reliability by reducing interference from predominantly vertically polarized signals in overlapping and adjacent frequency bands.

SUMMARY

Example embodiments of antennas that can transceive signals in a horizontally-polarized omni-directional manner are described. In an example embodiment, an antenna comprises a surface, shaped in such a way as to have a spiral cross-section, the surface forming an internal cavity, an internal channel to the external surface, and an internal wall common to the cavity and the channel. Further, an example embodiment comprises a longitudinal opening allowing radio frequency (RF) energy access to and from the cavity and the channel. Alternate embodiments comprise various cross-sectional configurations, and may also comprise a radome at least partially surrounding the antenna.

While described individually, the foregoing embodiments are not mutually exclusive and any number of embodiments may be present in a given implementation. Moreover, other antennas, systems, apparatuses, methods, devices, arrangements, mechanisms, approaches, etc. are described herein.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

FIG. 16A is a profile view, and FIG. 16B is a cross-section view of the radome.

DETAILED DESCRIPTION

Introduction

Figure 1A:
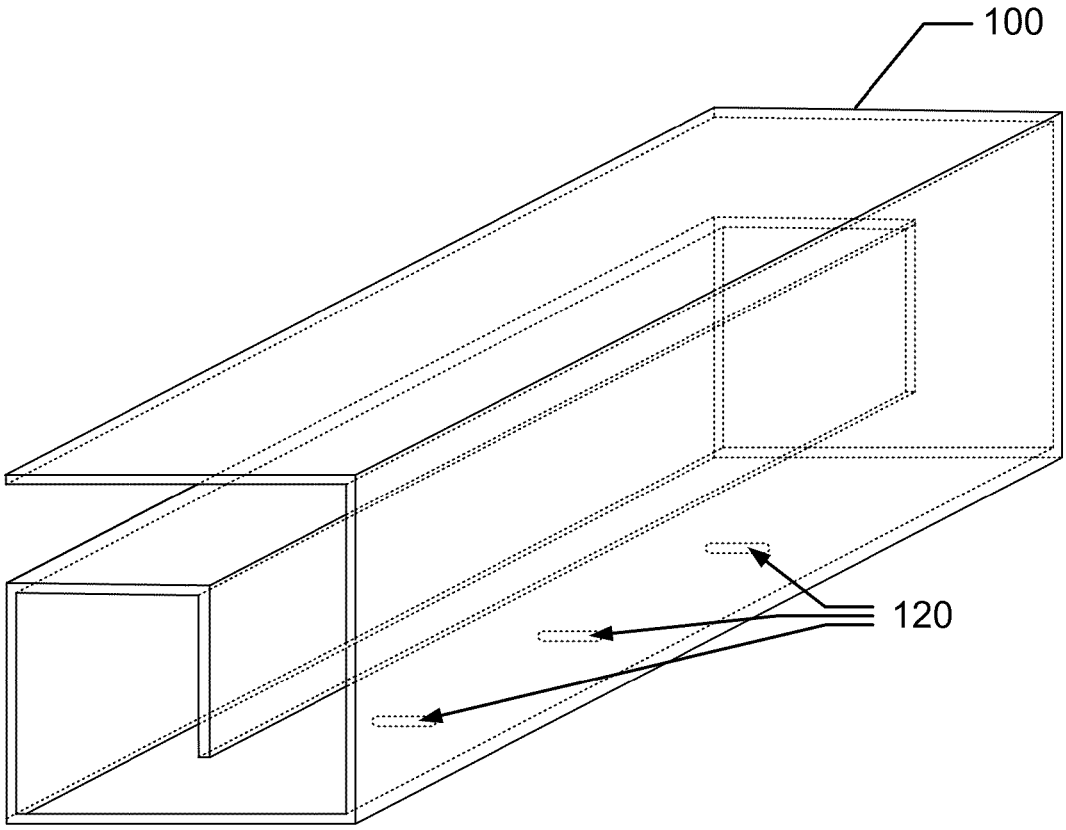
FIG. 1A illustrates a perspective view of an exemplary spiraling surface for constructing a horizontally-polarized omni-directional antenna, including apertures for inserting one or more transmission feed lines.

An antenna operated such that the electric field emanating from the antenna is parallel to a plane defined by the surface of the earth is said to be horizontally polarized. Note that a horizontally polarized antenna may be mounted or operated with the physical vertical axis of the antenna being substantially perpendicular to a plane defined by the surface of the earth, and still emanate an electric field that is parallel to the surface of the earth.

Compact horizontally polarized antennas have not proliferated the marketplace. Horizontally polarized antennas that have been developed and marketed are relatively large or are aesthetically obtrusive. Until recently, no slim horizontally polarized antenna having physical similarities to a vertical dipole has been commercially available. U.S. patent application Ser. No. 11/865,673, filed on Oct. 1, 2007, by inventors Royden M. Honda and Raymond R. Johnson, entitled "Horizontal Polarized Omni-Directional Antenna" describes an omni-directional horizontally polarized antenna, and is herein incorporated by reference in its entirety. The present application discloses various embodiments of a subsequently developed omni-directional antenna that has radiation characteristics similar in some respects to the slot antenna of the patent application mentioned, and includes a number of additional features discussed below.

Design Considerations

The spiral design has been utilized in mechanical, structural, and electrical engineering. The spiral has unique characteristics when applied to antenna designs. Most of the previous spiral antenna designs have been either a logarithmic or an Archimedean winding, etched on copper clad laminates. These two-dimensional designs have radiation emanating along the axis of the spiral and normal to the plane in which it lies. The radiation pattern of these two-dimensional antenna designs is bi-directional and generally is figure-eight shaped.

A spiraling surface antenna, as discussed herein, is a three dimensional antenna design, and has an omni-directional radiation pattern. A spiraling surface antenna design has many advantages over other antenna designs. For example, a spiraling surface antenna can be made smaller and achieve equivalent performance to a larger antenna of a different design, in terms of transmission and reception performance, omni-directional capabilities, far field radiation pattern, gain, and other characteristics. For example, unlike most other types of antennas, a spiraling surface antenna can implement electrical uptilt or downtilt through a simple repositioning of the antenna feed point within a single antenna.

Additionally, a spiraling surface antenna design may be generally easier to manufacture than an antenna of equal performance, and also may be easier to tune. Manufacturing a spiraling surface antenna need not require any machining, unless desired. Constructing a spiraling surface generally comprises bending or forming a conductive sheet. Further, tuning a spiraling surface antenna comprises merely judiciously placing a dielectric at a predetermined location within the cavity formed by the spiraling surface.

A spiraling surface antenna fed with a single feed in a centrally orientated location may achieve the performance of many multi-fed antennas of similar length. In contrast to other designs, a spiraling surface antenna may be constructed several wavelengths long and maintain a clean and complete radiation pattern.

It is to be understood for the purposes of this application that reference to wavelength ($\lambda$) implies a wavelength within a medium, the medium having a permittivity of 1.0 (free space) or greater. The permittivity of the medium results in an alteration to the velocity of propagation of an electromagnetic waveform relative to free space. This results in a wavelength that is shorter in non-free space media. The formula for a wavelength within a medium is as follows:

$$\lambda=\lambda_o/(\in_r)^{1/2}$$

where: $\lambda$=wavelength in the medium $\lambda o$=free space wavelength $\in_r$=permittivity of the medium Radiation emanating from an antenna is said to originate from a phase center. The phase center of an antenna is an imaginary point that is considered to be the source from which radiation occurs. The phase center of the radiation emanating from an antenna is sometimes also the physical center of the antenna, but in many cases it is not. In many cases, the phase center may not be on the antenna, but may be in space some distance from the antenna. The phase center of an antenna designed using a spiraling surface may be within the interior of the antenna, at a predetermined location either at or near the aperture.

The location of the phase center may not be the same as the physical origin of radiated energy within an excited spiraling surface antenna. The physical origin of the radiated energy is often at a coupling gap within a cavity formed by the spiraling surface. An antenna designed using a spiraling surface has a generally increasing radius from the coupling gap to the surface walls of the antenna as a generated electric field travels from the physical point of origin through the antenna chambers and is radiated out of the aperture of the spiraling surface antenna.

Exemplary Embodiments

Figure 1B:
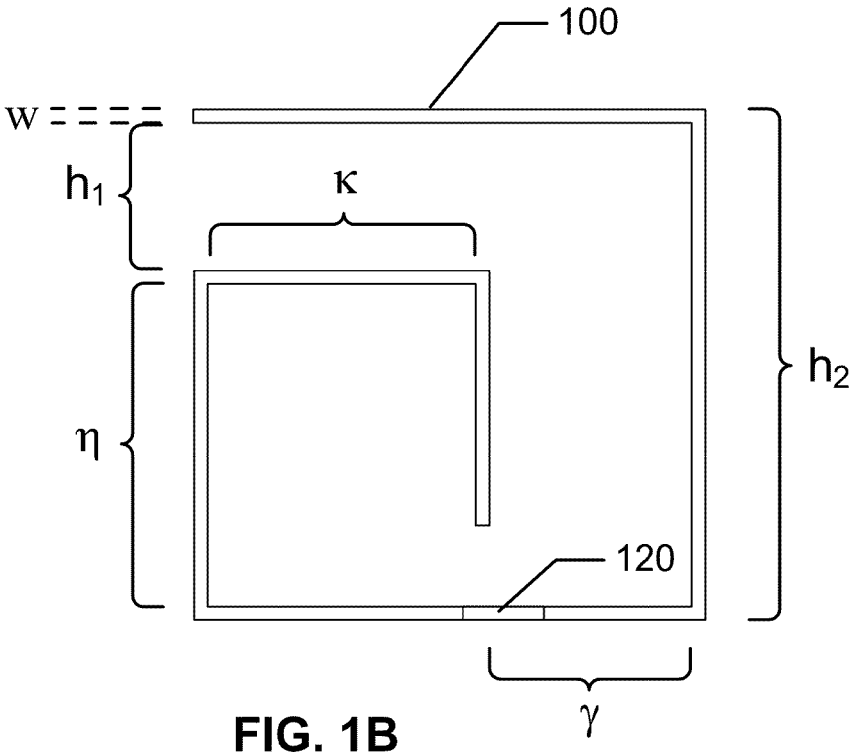
FIG. 1B illustrates an end view of the exemplary spiraling surface for constructing a horizontally-polarized omni-directional antenna shown in FIG. 1A.

A compact antenna constructed utilizing a spiraling surface 100 is disclosed. FIGS. 1A and 1B illustrate an exemplary spiraling surface 100 configured to be used in the construction of a horizontally-polarized omni-directional antenna. An antenna may be constructed from the spiraling surface 100 by coupling one or more signal transmission feed lines to the spiraling surface 100. Various configurations and embodiments of antennas utilizing a spiraling surface 100, or a similar spiraling design, will be discussed in the sections that follow.

As shown in the perspective view of FIG. 1A, the spiraling surface 100 may include one or more clearance holes 120 for inserting one or more transmission feed lines. The cross-section of the spiraling surface 100 is shown in FIG. 1B. The spiraling surface 100 may be constructed using a sheet of conductive material, or a material having a conductive surface that is formed into a spiral. Further details and methods of construction are discussed in later sections.

By way of example only, FIGS. 1A and 1B show the cross-section of the spiraling surface 100 having corners that are 90° angles. However, this does not preclude the use of other geometric shapes for the corners. Alternate embodiments of an antenna constructed with the spiraling surface 100 may be constructed using other geometric shapes for the corners, including smooth arcs or alternate polygonal shapes. Further, the spiraling surface 100 itself may be constructed so that it has a substantially circular cross-sectional shape, substantially elliptical cross-sectional shape, substantially polygonal cross-sectional shape, or the like. A spiraling surface 100 may also be constructed using combinations of the above shapes. In one embodiment, the cross-sectional shape of the spiraling surface 100 is continuous over the length of the spiraling surface 100. In an alternate embodiment, the cross-sectional shape of the spiraling surface 100 is discontinuous over the length of the spiraling surface 100.

Figure 2A:
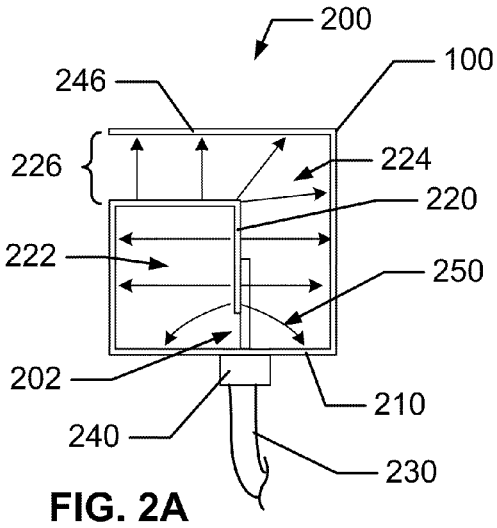
FIGS. 2A, 2B, and 2C illustrate production and expansion of an electric field within and around an exemplary spiraling surface antenna.
Figure 2B:
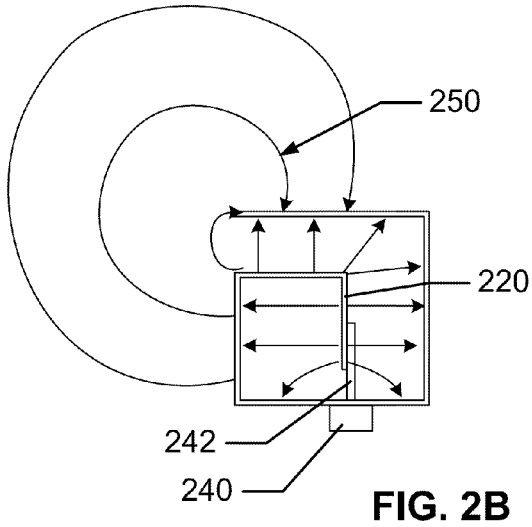
Figure 2C:
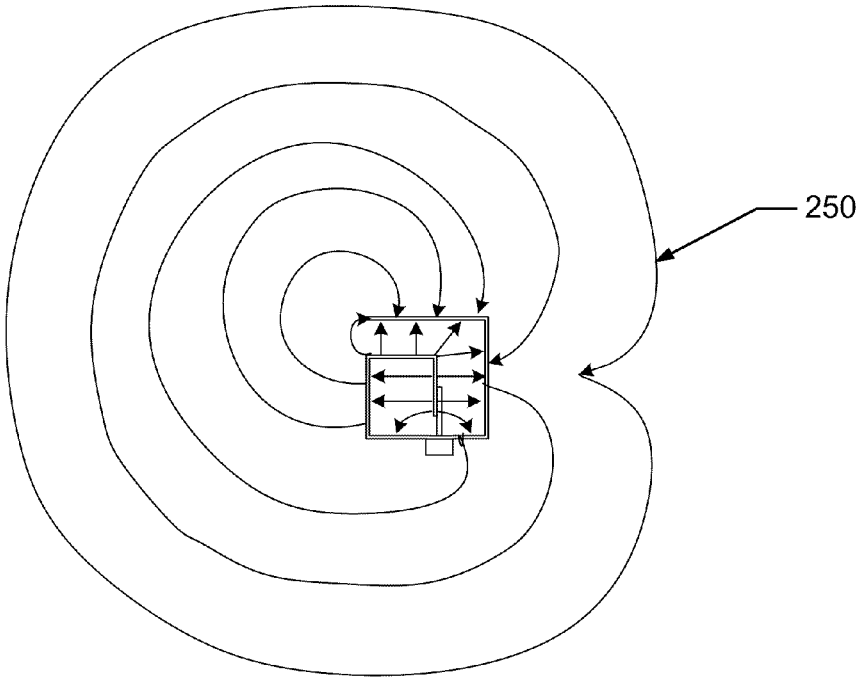

As shown in FIGS. 2A, 2B, and 2C, a spiraling surface 100 that is configured to be constructed into a spiraling surface antenna 200 may be comprised of an electrically conductive surface 100 shaped to have a spiraling cross-section, and forming the following: an external surface (outer wall) 210, an internal cavity 222, an internal channel (aperture channel) 224 that is internal to the external surface 210, and an internal wall (mid wall) 220 common to the internal cavity 222 and the aperture channel 224. The mid wall 220 may have a longitudinal opening (or gap) 202 configured to allow radio frequency (RF) energy access to the channel 224. For example, the mid wall 220 may have a longitudinal opening 202 that is transparent to RF energy, such that the RF energy may pass from the channel 224 to the cavity 222 or from the cavity 222 to the channel 224. Further, the longitudinal opening 202 may be electrically coupled to a signal feed 230 such that an electric field 250 is induced along the longitudinal opening 202.

FIGS. 2A, 2B, and 2C illustrate cross-sectional views of an antenna 200 constructed from the spiraling surface 100. The antenna 200 may be constructed by coupling a signal transmission feed line 230 to the spiraling surface 100 as discussed above. The cross-sectional views of the example spiraling surface antenna 200 in FIGS. 2A, 2B, and 2C show an open outer geometry, since the spiraling surface 100 does not wrap around and close on itself. However, in an alternate embodiment, a spiraling surface antenna 200 cross-section may have a closed outer geometry. In the alternate embodiment, the inner geometry of the spiraling surface antenna 200 may retain a spiraling cross-section, but the outermost layer of the spiraling surface may eventually wrap around and make contact with itself, closing the outer geometry of the cross-section.

An aperture 226 may be provided in either embodiment (open or closed outer geometry) to emit RF radiation from the overall geometry of the antenna 200. Additionally, as will be discussed, the length of the aperture 226 may affect the performance of the antenna 200. The aperture 226 should not be confused with the antenna's "effective aperture" which may be larger than the combined area formed by the aperture 226 and the surrounding surface 100 of the antenna 200. The effective aperture of an antenna is sometimes referred to as the capture area. It is the area from which a receiving antenna extracts energy from the impinging electromagnetic plane waves. As the effective aperture of an antenna 200 increases so does the gain of the antenna 200. For example, doubling the effective aperture of an antenna 200 may increase the gain of the antenna 200 by 3 dB.

One alternate embodiment of a spiraling surface antenna 200 includes a length extension (shown in FIG. 4A) configured to increase the length of the physical aperture 226 of the antenna 200 which provides for a greater number of useable wavelengths from the antenna 200. An increase in the length of the physical aperture 226 will result in an increase in the effective aperture of the antenna 200 and its concomitant antenna gain. Thus, a length extension of antenna 200, to increase antenna gain, may be equivalent to the method of increasing antenna gain by stacking a number of collinearly-aligned antennas into a column.

Figure 4A:
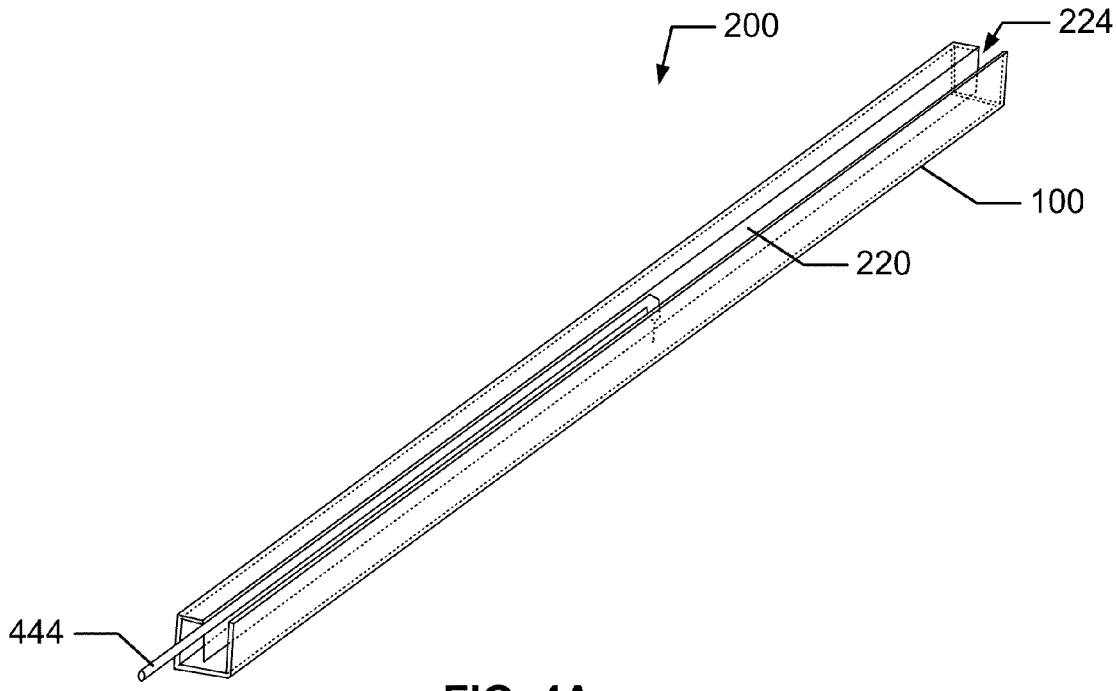
FIGS. 4A and 4B illustrate a perspective view and an end view, respectively, of an alternate embodiment of a spiraling surface antenna, the transmission feed line positioned along an edge of an aperture channel.

In one embodiment, a physical length extension of an antenna 200, and resulting increase in antenna effective aperture and gain, may be accomplished by extending the length of the spiraling surface 100 (as shown in FIG. 4A). For example, a longer spiraling surface 100 may be used to construct the antenna 200. In an alternate embodiment, other means may be used to provide a length extension, such as adding an extension spiraling surface 100 to the antenna 200.

Further, an antenna array may be constructed by stacking a number of collinearly-aligned spiraling surface constituent antennas (each constituent antenna being a complete antenna 200), thus forming a column. Each of the constituent antennas 200 may have a transmission feed line 230 associated with the constituent antenna 200. A feed point associated with each antenna feed line 230 may be spaced along the length of the column in such a way as to establish a desired phase relationship between each of the individual constituent antennas 200 in the column. Forming a column of antennas 200 may increase the effective aperture of the column with each antenna 200 added. Again, as the effective aperture of an antenna increases so does the gain of the antenna. For example, doubling the number of antennas 200 in the array increases the gain by 3 dB.

Alternatively, rows containing columns of one or more spiraling surface antennas 200 may be formed into an array. An array configured in this manner may be a planar array, or may be circular, elliptical, polygonal, or an array contoured to fit the shape of a structural surface. A desired phase relationship for each constituent antenna 200 in such an array may be determined by design, taking into account the intended application of the antenna array. For example, such an array may be configured so that it produces high antenna gain in the direction of low power utility meters and simultaneously produces low antenna gain in the direction of interfering sources, such as cellular telephony networks or internet service providers.

In the example embodiment shown in FIGS. 2A, 2B, and 2C, the ends of the antenna 200 are open. This does not preclude the use of end caps on an alternate embodiment of an antenna 200. In one alternate embodiment of the antenna 200, either conductive or non-conductive end caps may be placed on the ends of the antenna 200 without significantly diminishing the performance of the antenna 200. In a further embodiment, the antenna 200 may be capped on one end, and the other end may be left open, without significantly diminishing the performance of the antenna 200.

The antenna 200 may be configured for various particular applications as described herein. In one embodiment of a spiraling surface antenna 200, the antenna 200 may include a supporting structure (not shown) to support the antenna while in use. The supporting structure may be constructed of rigid or flexible, non-conductive and/or conductive material, depending on the intended use and likely installation requirements. An alternate embodiment of an antenna 200 includes a supporting structure that is a combination of rigid and flexible non-conductive and/or conductive material.

Figure 16A:
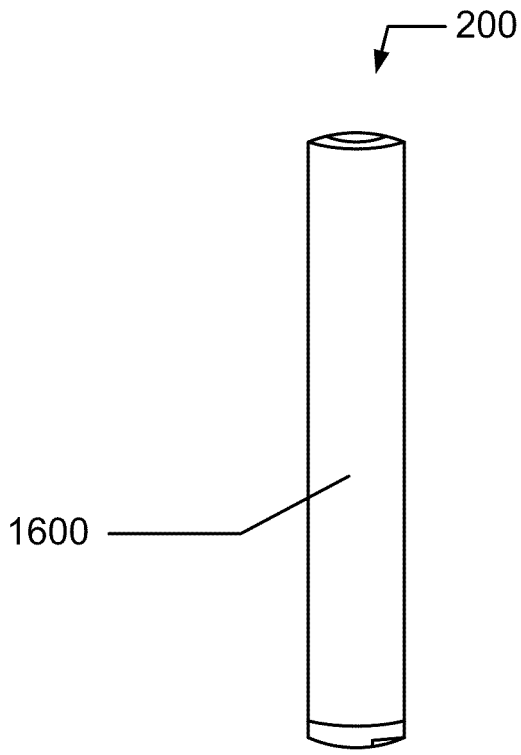
FIGS. 16A and 16B illustrate an example of a radome configured to surround, at least partially, an antenna.
Figure 16B:
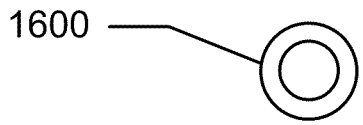

An antenna 200 may be designed to be relatively "slim," that is, it may have physical similarities to a dipole, but be a horizontally polarized omni-directional antenna. In a further embodiment, an antenna 200 may also include a radome 1600 (shown in FIGS. 16A and 16B) that either partially or completely surrounds the spiraling surface 100. In an alternate embodiment, the radome 1600 may also partially or completely surround any supporting structure included with the antenna 200. A radome 1600 is added to protect the antenna 200 from damage or to provide an impedance match between the antenna 200 and the propagation medium.

A radome 1600 may be a "structural" radome 1600 if it is intended to resist damage in outdoor applications. For example the radome 1600 may be constructed to survive mechanical loading experienced in high wind conditions or may be made of materials to resist corrosive atmospheres. Indoor environments may only require a simple non-structural coating on the antenna 200 to resist snags and to provide a pleasing aesthetic form. In one example, a coating or similar covering on the antenna 200 may be a "non-structural" radome 1600. In one embodiment, the radome 1600 is adapted to connect directly to an elevating member or a mounting structure for attachment purposes.

In an exemplary embodiment, the radome 1600 may have a cross-sectional shape (shown in FIG. 16B) configured to surround the antenna 200 (and may also be configured to surround a supporting structure). The cross-sectional shape of the radome 1600 may be a substantially circular shape or a substantially elliptical shape or a substantially rectangular shape. The cross-sectional shape of the radome 1600 may also be constructed using combinations of the above shapes. Note that a polygonal shape may be approximated by one or a combination of a substantially circular shape or a substantially elliptical shape or a substantially rectangular shape. Further, since the antenna 200 is slim, a defining smallest dimension of the cross-sectional shape (i.e., the diameter of a circle or minor axis of an ellipse or the shortest dimension of a rectangle) of a structural radome 1600 may be less than 0.194λ, or 0.194 times the wavelength of the center frequency of the antenna 200. Further, since the antenna 200 is slim, a defining smallest dimension of the cross-sectional shape (i.e., the diameter of a circle, minor axis of an ellipse, or the shortest dimension of a rectangle) of a non-structural radome 1600 may be less than 0.099λ, or 0.099 times the wavelength of the center frequency of the antenna 200.

For example, a structural radome 1600 configured for an antenna 200 designed around a center frequency of 915 MHz, may have a circular cross-section with a diameter of less than 2.5 inches and a non-structural radome configured for the same antenna 200 may have a diameter of less than 1.28 inches. For another example, a structural radome 1600 configured for an antenna 200 designed around a center frequency of 2437 MHz, may have an octagonal cross-section with a maximum dimension (the diagonal from one vertex to a directly opposite vertex) of less than 1 inch and a non-structural radome 1600 configured for the same antenna 200 may have a maximum dimension of less than 0.48 inches.

In an alternate embodiment, the radome 1600 may have the dimensions discussed above when applied to an alternate slim horizontally polarized, omni-directional antenna, such as the antenna described in U.S. patent application Ser. No. 11/865,673, discussed above and incorporated by reference herein.

In one embodiment, a spiraling surface antenna 200 may be partially or completely enveloped with a dielectric material. This process, referred to as dielectric loading, may include filling the internal cavities of the spiraling surface antenna 200 with a dielectric material. Dielectric loading may allow all dimensions of the antenna 200 to be reduced as a function of the wavelength of operation in the dielectric. This means that each physical dimension of an antenna 200 that is designed to operate at a particular center frequency may be reduced in size by an equal ratio when dielectric loading is applied to the antenna 200. For example, all physical dimensions of an antenna 200 may be reduced by a factor of 0.53 if the antenna 200 is dielectrically loaded utilizing a dielectric with a permittivity of 3.5. However, dielectric loading may affect the efficiency of an antenna 200 based on the dissipation factor of the dielectric used.

Dielectric loading may further reduce the slim cross-sections of radomes 1600 discussed previously by a corresponding factor based on the dielectric's permittivity. As mentioned above, an antenna 200 designed around a frequency of 2437 MHz, with an air dielectric may include a structural radome 1600 with a maximum dimension of less than 1 inch. An antenna 200 designed around the same frequency, but dielectrically loaded using a material with a permittivity of 3.5, may result in a structural radome 1600 having a maximum dimension of less than 0.53 inches.

While various discreet embodiments have been described, the individual features of the various embodiments may be combined to form other embodiments not specifically described. The embodiments formed by combining the features of described embodiments are also considered spiraling surface antennas 200.

Exemplary Antenna Excitation

A spiraling surface antenna 200 can be excited in several ways. FIGS. 2A, 2B, and 2C illustrate an example of an excitation method. A coaxial cable outer conductor 240 is terminated and affixed to an outer wall 210 of a spiraling surface antenna 200. The center conductor 242 of the cable continues through a clearance hole 120 in the outer wall 210 and is terminated and affixed to the mid wall 220 of the spiraling surface antenna 200 as shown. The mid wall 220 is an internal wall common to the internal cavity 222 and the internal channel 224. The coaxial cable outer conductor 240 and inner conductor 242 may be electrically coupled to portions of the antenna 200 by conductive connections, inductive coupling, capacitive coupling, or the like.

The initial excitation of the antenna 200 is illustrated in FIG. 2A. When a RF signal flows through a feed line 230, the current flowing in the line encounters an abrupt change at the terminus of the outer conductor 240 of the cable. A voltage potential is created at the coupling gap 202, between the mid wall 220 and the outer wall 210, inducing an electric field (E field) 250 across the coupling gap 202 along the entire length of the antenna 200. The induced E field 250 travels into the cavity 222 and the aperture channel 224. The E field 250 in the cavity 222 is reflected by the walls of the spiraling surface 100 and travels back to the gap 202 and into the aperture channel 224 where it unites with the field 250 in the aperture channel 224.

The excitation process is further illustrated in FIG. 2B. The E field 250 travels along the walls of the aperture channel 224 until it reaches the end of the walls, at the aperture 226. The E field 250 exits through the aperture 226, and continues to travel outward along the outside surface of the spiraling surface 100.

The continued excitation of the antenna and associated radiation of the RF signal is illustrated in FIG. 2C. The E field 250 continues to travel outward along the conductive spiraling surface 100 until the tail end of the E field 250 vector meets the head end of the same vector. At this stage both ends of the vector unite to form a continuous vector, breaking away from the conductive boundary of the spiraling surface 100, and moving outward into free space, eventually becoming similar to a circular wave front emanating away from the spiraling surface 100. When the axis of the spiraling surface antenna 200 is positioned vertically, the azimuth (horizontal plane) radiation pattern is omni-directional and the polarization of the E field 250 is horizontal.

Performance Considerations

Figure 3A:
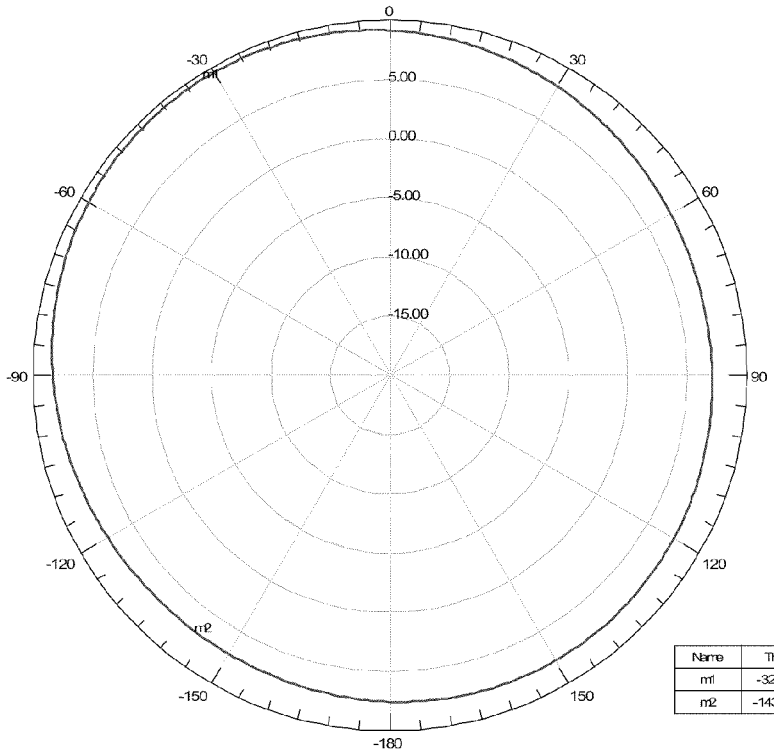
FIGS. 3A and 3B illustrate far field radiation patterns in the horizontal plane for spiraling surface antennas of different dimensions.
Figure 3B:
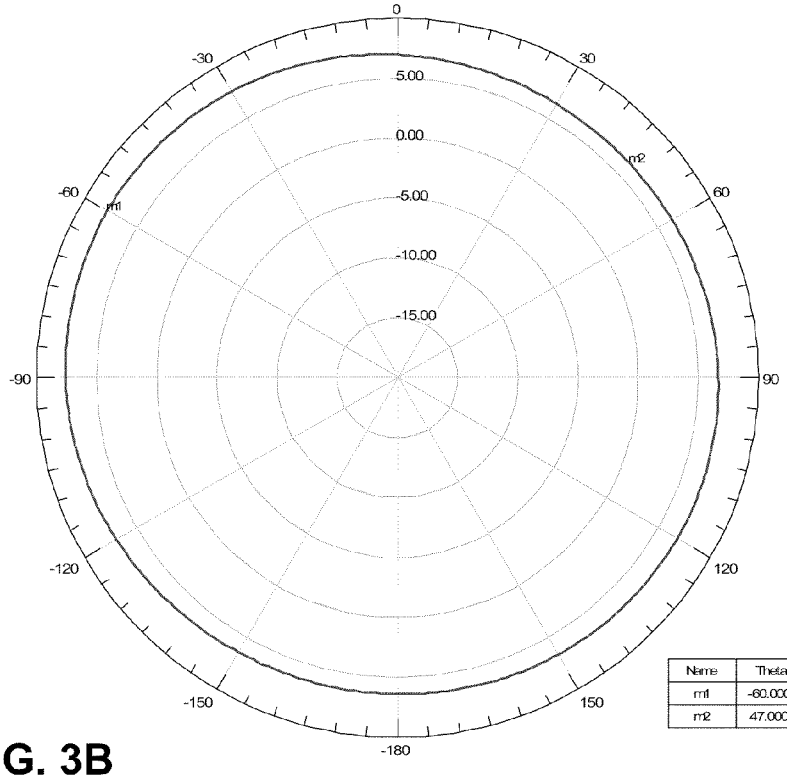

The cross-sectional geometry of a spiraling surface antenna 200 has a definite influence on its omni-directional radiation pattern. FIGS. 3A and 3B are far field radiation pattern plots that illustrate the potential deviation from a perfect omni-directional radiation pattern. FIGS. 3A and 3B illustrate the horizontal plane radiation patterns, and specifically, the different maximum to minimum gains in the omnidirectional radiation pattern for a 0.1λ, square cross-section (FIG. 3A) and a 0.078λ, cross-section (FIG. 3B) of a spiraling surface antenna 200.

If the diameter of a circle or the diagonal of a rectangle that circumscribes the cross-section of the spiraling surface antenna 200 is comparatively large, say greater than 0.1λ, the excursion from maximum to minimum gain variation in omni-directionality can be 4 dB or greater. For example, as shown in FIG. 3A, a cross-section of 0.1λ square will give a gain delta (minimum to maximum) of approximately 3 dB. This delta value is sometimes expressed as ±1.5 dB about the mean gain value. As shown in FIG. 3A, the maximum gain is represented by "m1" and the minimum gain is represented by "m2."

As shown in FIG. 3B, a cross-section of 0.078λ square results in a delta of approximately 1.5 dB (±0.75 dB). Here again, the maximum gain is represented by "m1" and the minimum gain is represented by "m2." The variance in the omni-directional pattern in both cases may be attributed to the location of the phase center relative to the axis of the antenna 200 and the surface contour that the E field 250 must traverse before it is transformed into an electromagnetic wave (comprising E field 250). As mentioned above, the phase center of any antenna is an imaginary point that is considered to be the source from which radiation occurs. In the case of antenna 200, the location of the phase center is either at or very near the aperture 226 and can either be measured or calculated if the field equations are known.

There is a proportional relationship between the cavity 222 and the channel 224 that may be important for satisfactory performance of the antenna 200. Referring again to FIG. 1, the height of the channel 224 ($h_1$) and the cavity 222 (η) is the height of the channel wall 220 ($h_2$) less the top and bottom wall thickness (w). The width of the cavity 222 (κ) may generally be twice the channel 224 width (γ). For example, in the case of an exemplary spiraling surface antenna 200 with a 0.1λ square cross-section having equal wall thickness, the cavity height (η) and cavity width (κ) are obtained from the relationships:

$\eta=0.1\lambda-2w$ where w=wall thickness, and λ=wave length $\kappa=2\gamma$ where γ=channel width $3\gamma=0.1\lambda-3w$ $$\gamma=\frac{.1\lambda-3w}{3}$$

Varying the length of a spiraling surface 100 used in the construction of an antenna 200 may have the following results: For resonant operation, the minimum antenna 200 length should be λ/2, which will give performance similar to a λ/2 dipole antenna. In one example, a λ/2 antenna designed to transmit and/or receive at 900 MHz may be about 16 cm in length. However, the length of the spiraling surface 100 can be shorter, for example λ/4, and still have reasonable performance, but will function more as a resonator than a resonant stand-alone antenna. A resonator is a foreshortened antenna that uses the host on which it is mounted as part of the antenna structure. Resonator antennas are used in hand-held and other devices where space is at a premium.

In alternate embodiments, the spiraling surface 100 can be made longer, for example several wavelengths long, with concomitant increase in antenna gain (as discussed above). In a further embodiment, a number of single λ/2 spiraling surface antennas 200 can be stacked in vertical array fashion to obtain approximately the same performance as a continuous spiraling surface 100 of the same length (also discussed above).

Excitation Techniques and Alternate Embodiments

Figure 4B:
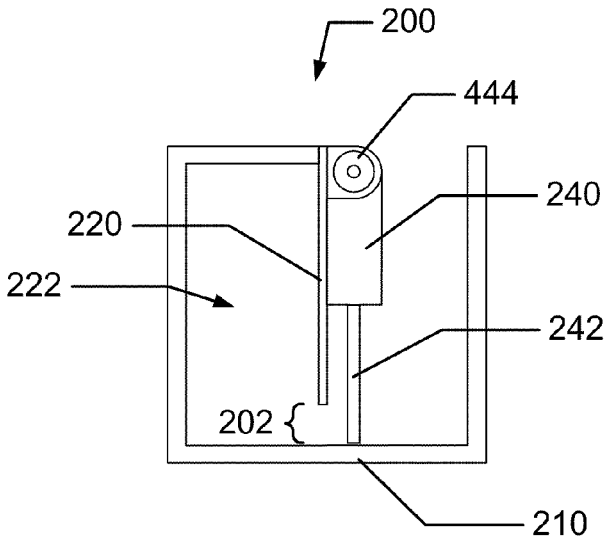

As mentioned previously, a spiraling surface antenna 200 can be excited in several ways. In one embodiment, an RF connector can be attached to an outer wall 210 of the antenna surface 100 as shown in FIG. 2A, and described above. In another embodiment, a coaxial cable 444 is positioned along the length of the aperture channel 224 and attached to the mid wall 220 as shown in FIGS. 4A and 4B.

The cable 444 is bent at the feed location and the outer shield 240 is terminated and affixed to the mid wall 220 just above the coupling gap 202. The center conductor 242 of the cable 444 extends beyond the outer shield 240 and is terminated and affixed to the outer wall 210 perpendicular to the mid wall 220. In a variation on this embodiment, the cable 444 is positioned in the cavity 222 along the mid wall 220 in mirror image to the configuration shown in FIGS. 4A and 4B.

Attaching the cable 444 to the mid wall 220 may be challenging in some cases. Thus, other embodiments may include placement of the coaxial cable 444 along the outside of the outer wall 210 or along the outside of the aperture wall 246 (see FIG. 2). In either of these embodiments, a clearance hole (not shown) may be provided so that the center conductor 242 can pass through a wall to a feed location inside the antenna 200.

Figure 5A:
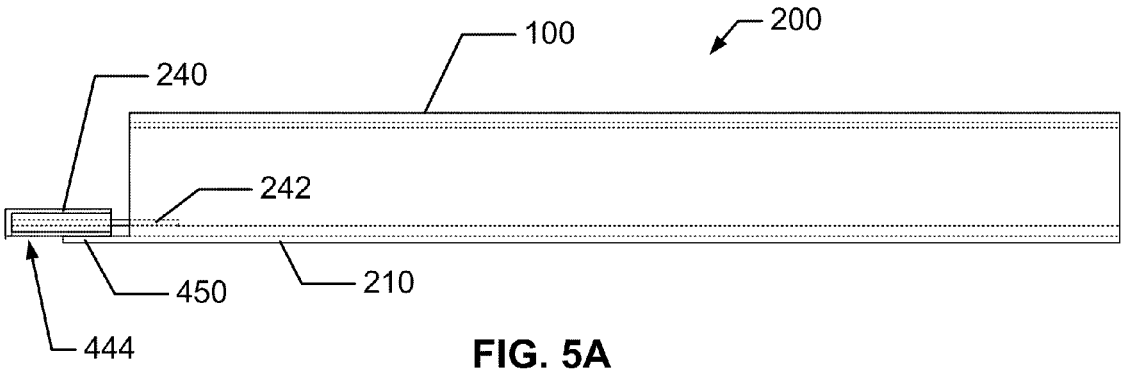
FIGS. 5A, 5B, and 5C illustrate side, top and end views, respectively, of an alternate embodiment of a spiraling surface antenna, the transmission feed line positioned at an end of the spiraling surface, the cable outer conductor coupled to an outer wall, and the cable inner conductor coupled to a mid wall.
Figure 5B:
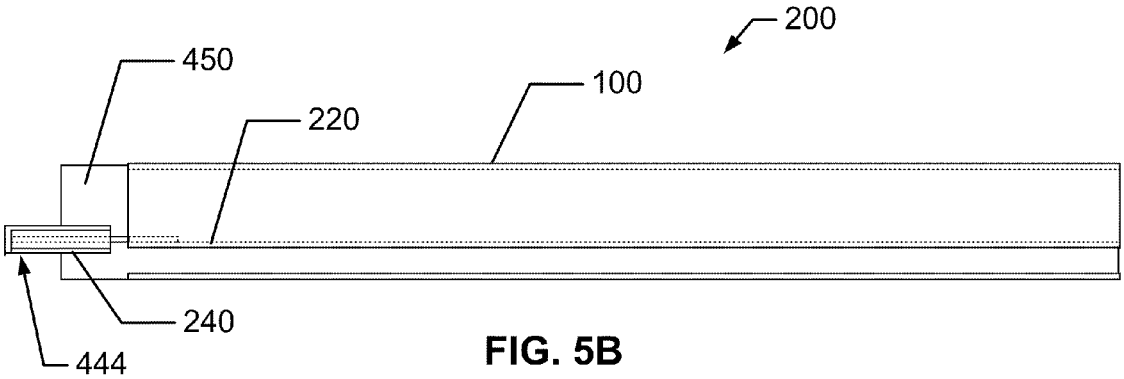
Figure 5C:
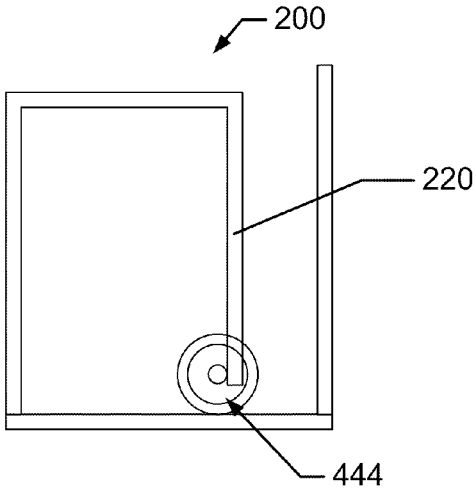

In another embodiment, the coaxial cable 444 is positioned at one end of the spiraling surface antenna 200 as shown in FIGS. 5A, 5B, and 5C. In one configuration, the outer shield 240 of the cable 444 is coupled to the inner surface of an outer wall 210, and the center conductor 242 is coupled to the mid wall 220. In one example, the outer wall 210 is formed such that a portion of the outer wall 210 extends parallel to the spiraling surface antenna 200, and beyond the length of the spiraling surface 100, forming an extension 450. As illustrated in FIGS. 5A and 5B, the outer shield 240 of the coaxial cable 444 may be coupled to the extension 450.

Figure 6A:
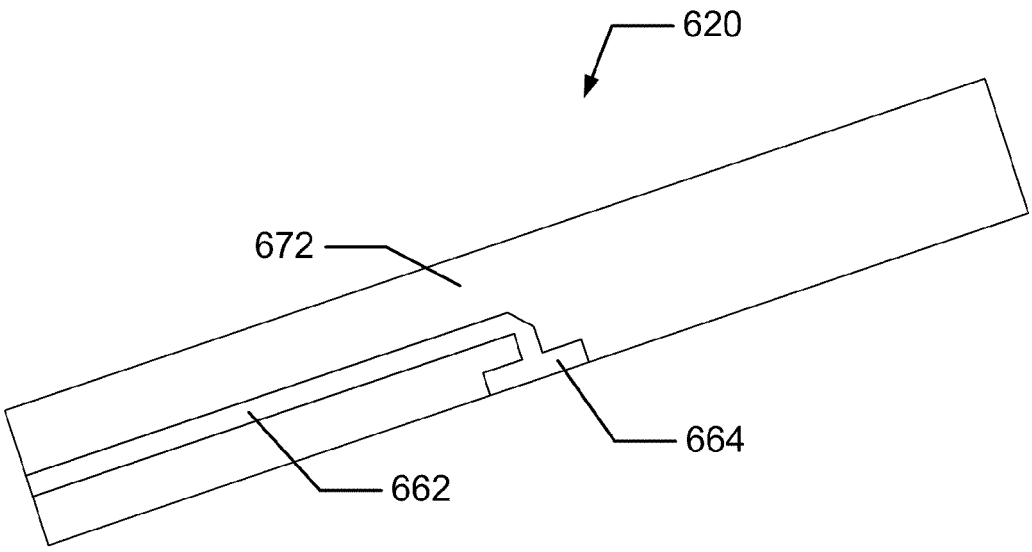
FIG. 6A illustrates an exemplary printed circuit board (PCB) with a microstrip line and antenna feed printed on one side, which may be positioned within a spiraling surface, and may also serve as a mid wall of a spiraling surface antenna assembly.

In an alternative embodiment, a printed circuit board (PCB) 620 may be used inside the spiraling surface 100 to excite the antenna 200. FIG. 6A shows a PCB 620 with a microstrip line 662 and an antenna feed 664 printed on one side of the PCB 620. The PCB 620 is configured to be placed within the spiraling surface 100, where the PCB 620 also serves as the mid wall 220 of the spiraling surface antenna 200 assembly.

Figure 6B:
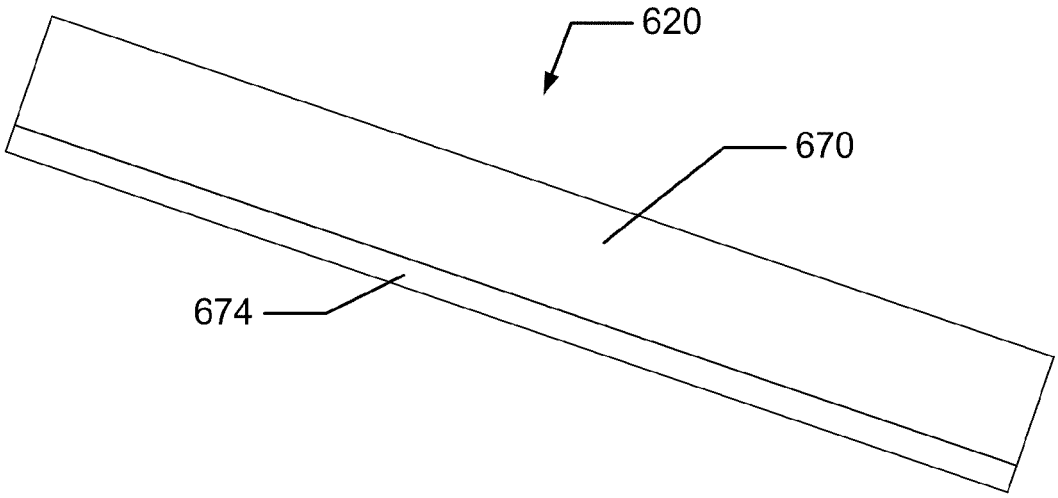
FIG. 6B illustrates the reverse side of the exemplary PCB of FIG. 6A, showing a ground plane for the microstrip, with a portion of the ground plane etched away, revealing a dielectric substrate.

FIG. 6B illustrates a ground plane 670 for the microstrip line 662, which may be located on the reverse side of the PCB 620. A portion of the ground plane 670 in FIG. 6B has been etched away showing the dielectric substrate 672 comprising the PCB 620. In an example antenna 200, the etched away area 674 serves as a coupling gap 202 between the cavity 222 and the aperture channel 224.

The arrangement of the microstrip line 662, antenna feed 664, and ground plane 670 as shown in this example does not preclude other arrangements of these elements on a PCB 620. In alternate embodiments, the microstrip line 662, antenna feed 664, and ground plane 670 may be positioned on the same side of a PCB 670, or within multiple layers of a multi-layered PCB 670.

Figure 7A:
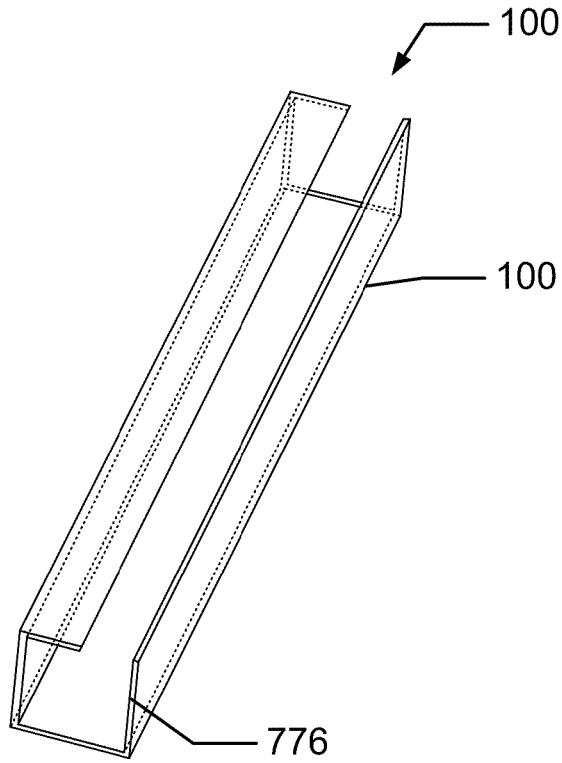
FIG. 7A illustrates an example of a partial spiraling surface assembly for receiving a printed circuit board (PCB) as a mid wall of a spiraling surface antenna assembly.
Figure 7B:
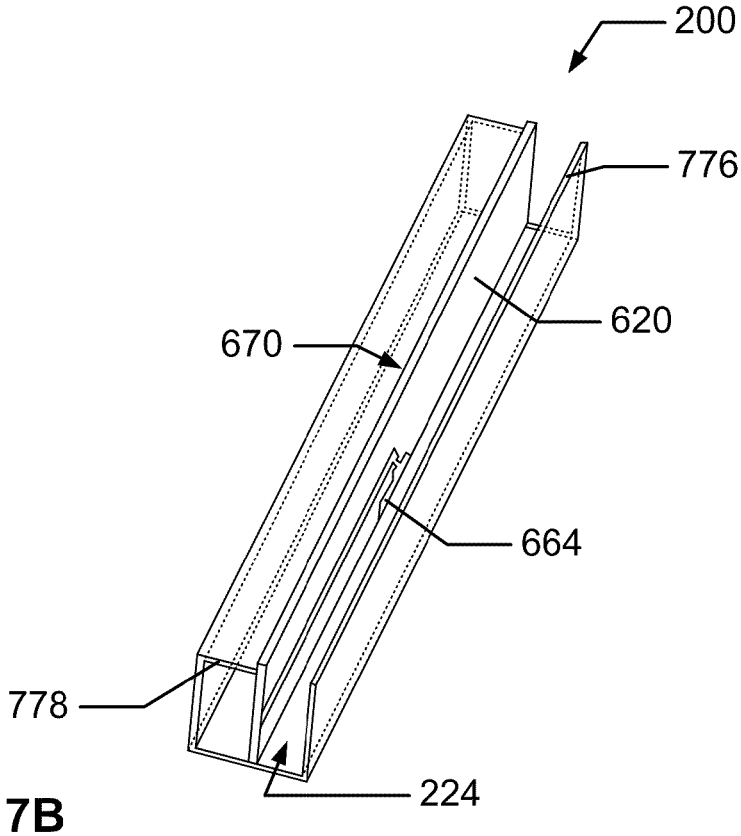
FIG. 7B illustrates the partial spiraling surface assembly of FIG. 7A with a printed circuit board (PCB) positioned as a mid wall of the spiraling surface antenna assembly.

FIG. 7A illustrates an embodiment of an antenna 200 with a modified spiraling surface 100 without a mid wall 220. Also in this example, the upper aperture wall 246 and some of the side aperture wall 776 may not be present to accommodate placing the PCB 620 (as shown in FIGS. 6A and 6B and described above) into the spiraling surface 100. The feed 664 located on the PCB 620 may be affixed to the inside of the spiraling surface 100. As shown in FIG. 7B, the ground plane 670 located on the PCB 620 may be bonded to the upper cavity wall 778 using a conducting adhesive, or the like.

Figure 8A:
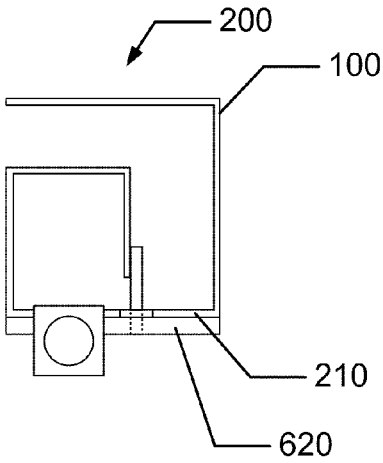
FIGS. 8A, 8B, and 8C illustrate several views of an alternate embodiment of a spiraling surface antenna comprising multiple transmission line feed inputs, the transmission feed line positioned along the outside of the outer wall of the spiraling surface.
Figure 8B:
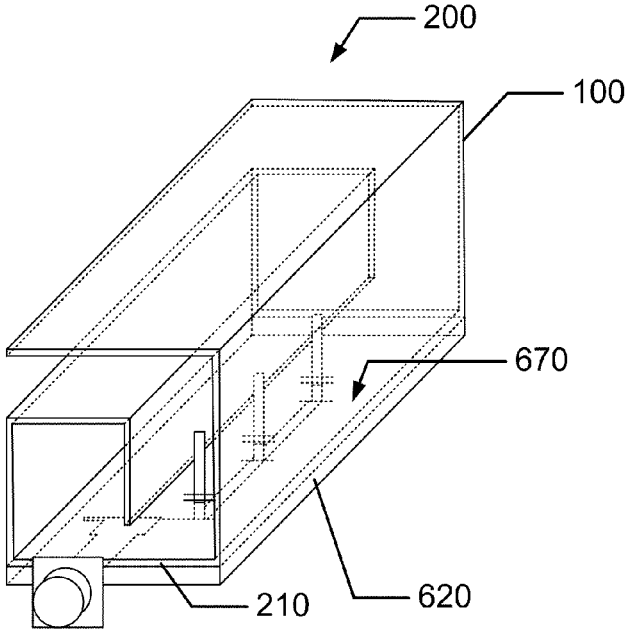
Figure 8C:
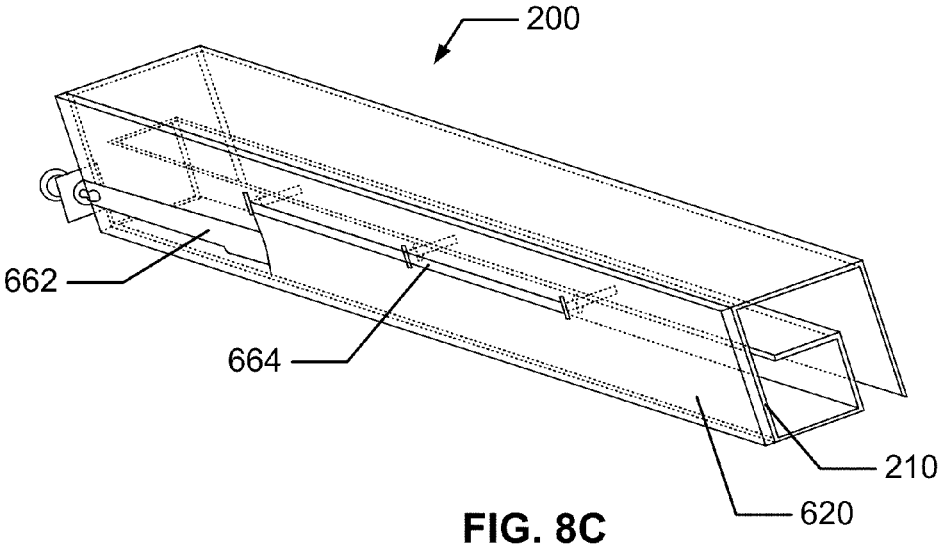

FIGS. 8A, 8B, and 8C illustrate an alternate embodiment of an antenna 200 using a multi-feed version of a PCB 620, where the PCB 620 is located on the outer wall 210 of a spiraling surface 100. For this design, the PCB 620 may or may not include a conductive layer for a ground plane 670 to pair with the microstrip line 662. In one embodiment, the PCB 620 includes a conductive layer ground plane 670 either on one or both sides of the PCB 620, or within a layer of the PCB 620.

In another embodiment, the PCB 620 may not include a conductive layer ground plane 670, and a conductive outer wall 210 of the spiraling surface 100 may serve as a ground plane 670 for the microstrip line 662. In this embodiment, care must be taken to ensure that the PCB 620 is continuously flat against the outer wall 210 to maintain a consistent impedance of the microstrip 662 and series feed line 664. In an alternate version of this embodiment, the PCB 620 may be located such that it is entirely within the spiraling surface 100.

Far Field Radiation

Relationships between the physical cross-section and the phase center of a spiraling surface antenna 200, and the resulting omni-directional radiation pattern were discussed above. The principles discussed are relevant to various possible feeding techniques, including single or multi-feed systems. As previously noted, FIGS. 3A and 3B illustrate the different maximum to minimum values in the omni-directional pattern for a 0.1λ, square cross-section and a 0.078λ, cross-section respectively in the horizontal plane.

Figure 9A:
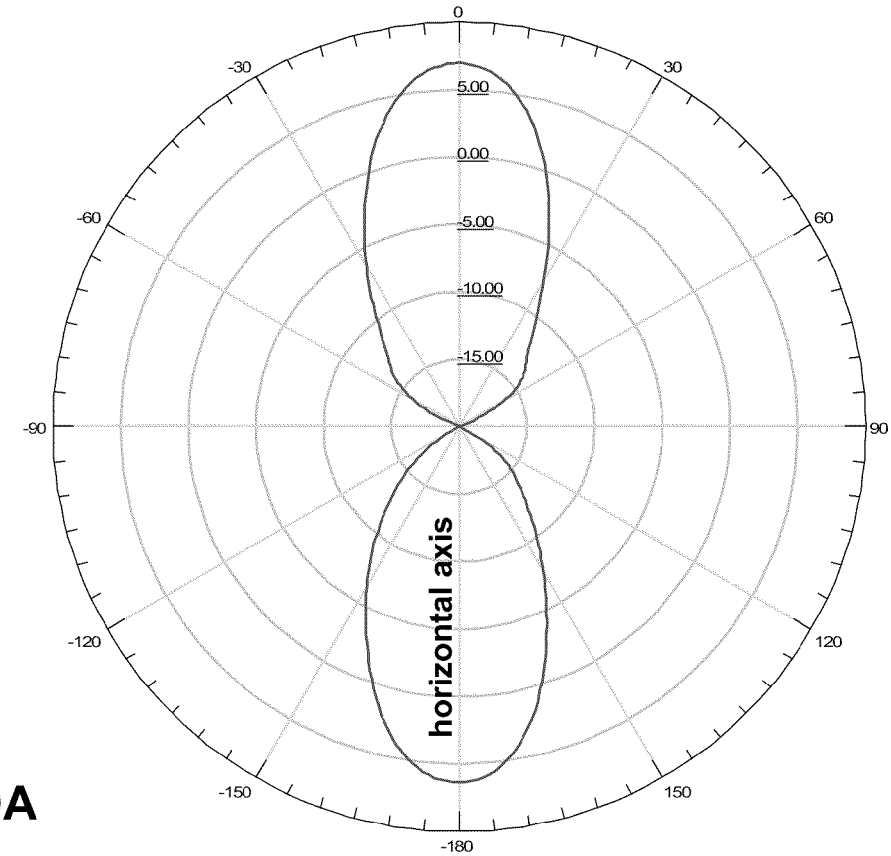
FIGS. 9A and 9B illustrate exemplary far field radiation patterns in the vertical plane for spiraling surface antennas with single feed at the center and with a multiple feed excitation, respectively.
Figure 9B:
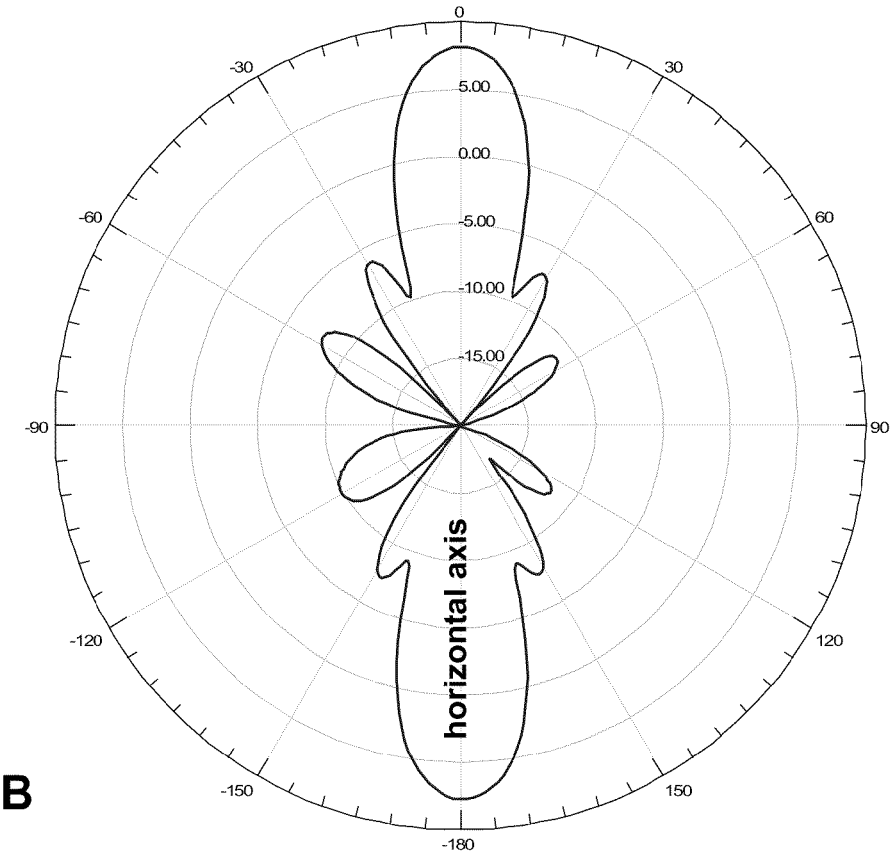

An antenna's far field radiation pattern in the vertical plane (the elevation pattern), however, may be affected by the way the E field 250 is distributed across the aperture 226. FIGS. 9A and 9B illustrate exemplary far field radiation patterns in the vertical plane for spiraling surface antennas 200 with a single feed at the center (FIG. 9A) and with a multiple feed excitation (FIG. 9B), respectively.

As shown in FIG. 9A, a single feed located at or near the center of a spiraling surface 100 may induce a tapered field across the coupling gap 202. The peak of the tapered field may be located at or near the center of the antenna 200 and the intensity may diminish following a cosine curve as the field approaches the ends of the antenna 200. This type of radiation field pattern may occur for both an open ended and a closed ended spiraling surface antenna 200. The illumination taper at the aperture 226 results in a very low side lobe level as seen in FIG. 9A.

Figure 10A:
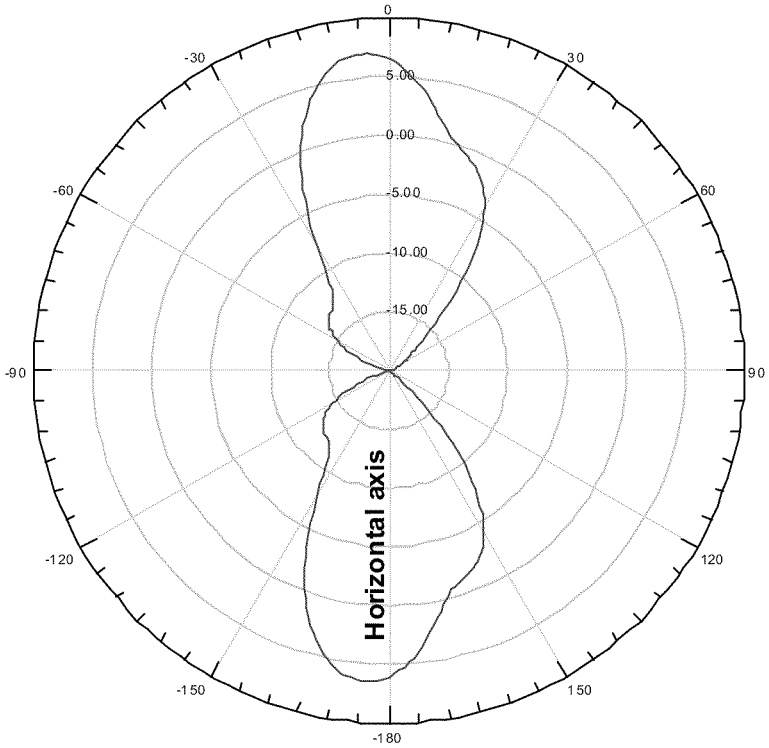
FIGS. 10A and 10B illustrate exemplary far field radiation patterns showing the elevation pattern and the azimuth pattern, respectively, for a spiraling surface antenna with modifications to feed positions.

Moving the single feed location (the point on the antenna 200 where the feed is coupled to the antenna 200) away from the center of a spiraling surface antenna 200 may change the direction of the RF energy beam emitted by the antenna 200. A change of the feed location away from the center of the antenna 200 may cause the beam direction to tilt away from the boresight direction, meaning the horizontal axis (parallel to the earth's surface). Assuming a vertically mounted antenna 200, if the feed point is moved below the center of the antenna 200, the resulting beam is tilted upward, or above the horizontal axis as shown in FIG. 10A. Conversely, if the feed point is moved above the center of the antenna 200, the resulting beam is tilted downward, or below the horizontal axis.

As shown in FIG. 9B, with a multi-feed antenna 200 system, the illumination at the aperture 226 approximates a uniform distribution and side lobes may appear in the resulting radiation pattern. A true uniform amplitude distribution may have a side lobe magnitude about −12 dB relative to the peak of the beam. With a multi-feed antenna 200, the gain may be slightly higher and the beam width may be narrower than with a single feed case. The amplitude of the individual feeds can be adjusted resulting in desired side lobe levels.

To accomplish beam tilting with a multi-feed configuration, the feed line 230 lengths to each feed point may be adjusted to produce the proper phase front of the emanating wave. Adjusting the feed line 230 lengths to predetermined lengths may change the respective phase of the feed lines 230, and thus produce the desired phase relationship between the signals carried on the feed lines 230. In an alternate embodiment, other methods to achieve a phase change in signals transmitted on multiple feed lines 230 are employed.

Figure 10B:
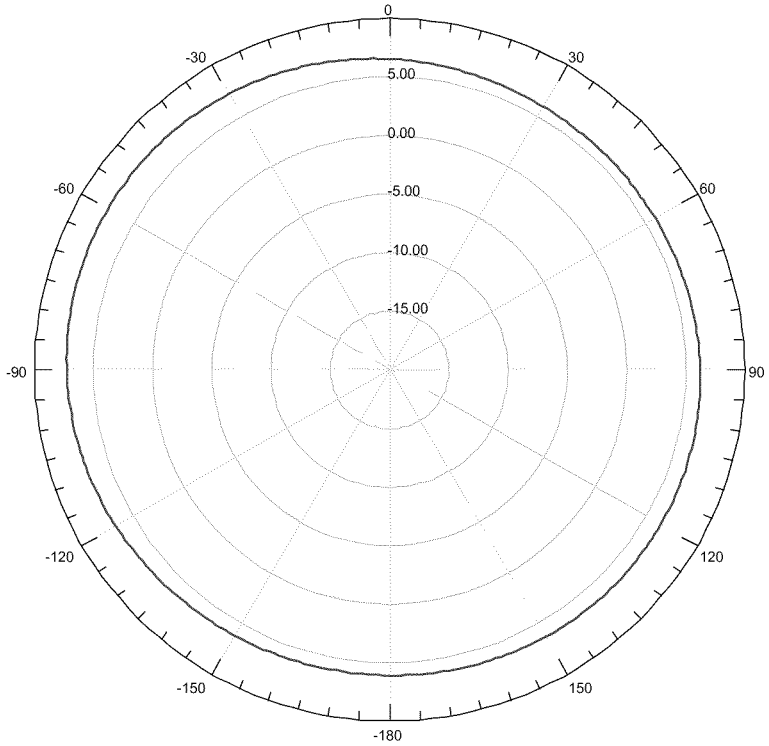

The pattern of radiation associated with an example multi-feed configuration, including tilt of the beam and beam elevation may be represented on a far field antenna elevation radiation pattern, such as the one shown in FIG. 10A. In the example far field radiation pattern shown in FIG. 10A, the illustration represents a pattern where the elevation has been tilted to 6° above horizontal. The pattern shown in FIG. 10B represents an azimuth pattern of the tilted beam pattern shown in FIG. 10A. In an alternate embodiment, a similar result may be accomplished using multiple constituent antennas 200 instead of multiple feeds to a single antenna 200.

An embodiment including multiple constituent antennas 200, as discussed above, may be controlled using one or more switching means. Often the individual constituent antennas 200 in a multi-unit antenna have been configured to "tilt" at differing degrees to accommodate environmental changes throughout the year at an installation site. The switching means may be used to control the magnitude and phase of the constituent antennas 200, and therefore control the overall tilt, beam elevation, and pattern. The switching means may include one or more single-pole double-throw switches, or any other means for coupling and de-coupling a constituent antenna 200, including mechanical or electrical switching means, or the like. In one embodiment, each individual constituent antenna 200 has a single switching means attached in line with the transmission feed line 230 associated with the constituent antenna 200. Activating the switching means associated with that particular constituent antenna 200 activates the constituent antenna 200, and alters the overall radiation pattern of the multi-unit antenna, based on the individual beam of the constituent antenna 200 activated.

In one embodiment, the switching means may comprise one or more amplitude adjustment and phase shifting means to effect a variation in the radiation pattern. The amplitude and phase of each constituent antenna 200 may be modified to produce unique patterns desirable to improve transmit and receive performance. For example, the amplitude of a constituent antenna 200 may be adjusted to a greater or lesser value, resulting in a change to the range of the antenna 200 in particular elevations. Additionally, the phase angle of the constituent antenna 200 may be adjusted to a greater or lesser phase angle, resulting in a change to the shape of the radiation pattern in elevation. Thus, the overall radiation pattern of a multi-unit antenna group may be modified as desired by making amplitude and/or phase adjustments to one or more of the constituent antennas 200. For example, a desired radiation pattern that may be produced using the switching means discussed above may include a pattern having high gain in the directions of intended clients, and low gain in the directions of interfering sources and/or in the direction of unintended receivers.

Figure 11A:
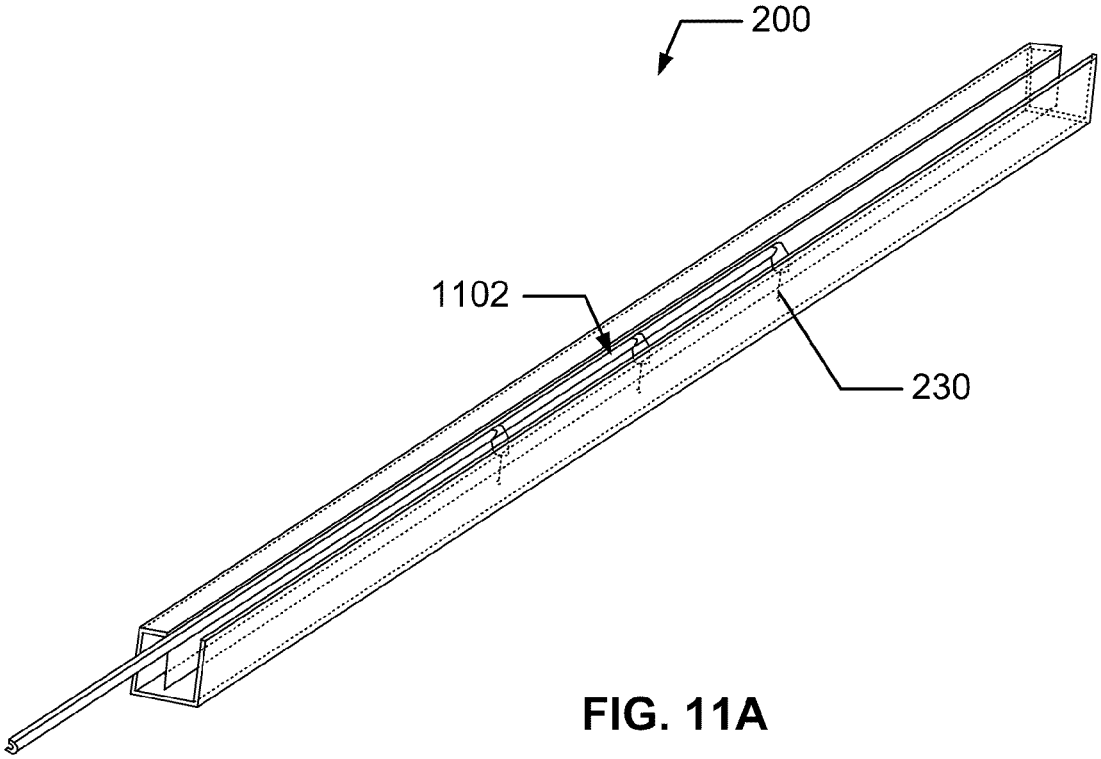
FIGS. 11A and 11B illustrate a mechanical sliding means where an infinite number of feed points to a spiraling surface antenna can be selected, and a finite set of feed points may be selected by a switching means, respectively.

In one example, as shown in FIG. 11A, the switching means and amplitude adjustment means comprise a single mechanical sliding means 1102 where an infinite number of feed points can be individually selected. The sliding means 1102 may be mechanically coupled to one or more feed lines 230, and to the surface of the antenna 200. In the example illustrated in FIG. 11A, a single feed line 230 is coupled to the sliding means 1102. The feed line 230 is shown in three alternate positions, where an infinite number of positions are possible. In another embodiment, multiple feed lines 230 may be coupled to the sliding means 1102.

In one example, the mechanical sliding means 1102 may include guides to slide the feed line along the length of the antenna 200, thereby selecting adjustment positions, in a manner similar to a potentiometer. A selected adjustment position determines the antenna pattern of a single antenna 200, or multiple constituent antennas 200, by coupling to the surface of the antenna 200 at various locations along the length of the antenna 200. In alternate embodiments, the mechanical sliding means 1102 may be another type of analog switching device, such as an electro-mechanical device, an electrical device, electronic components, or the like. In a further embodiment, the mechanical sliding means 1102 may be implemented by an electronic or digital device, or the like.

Figure 11B:
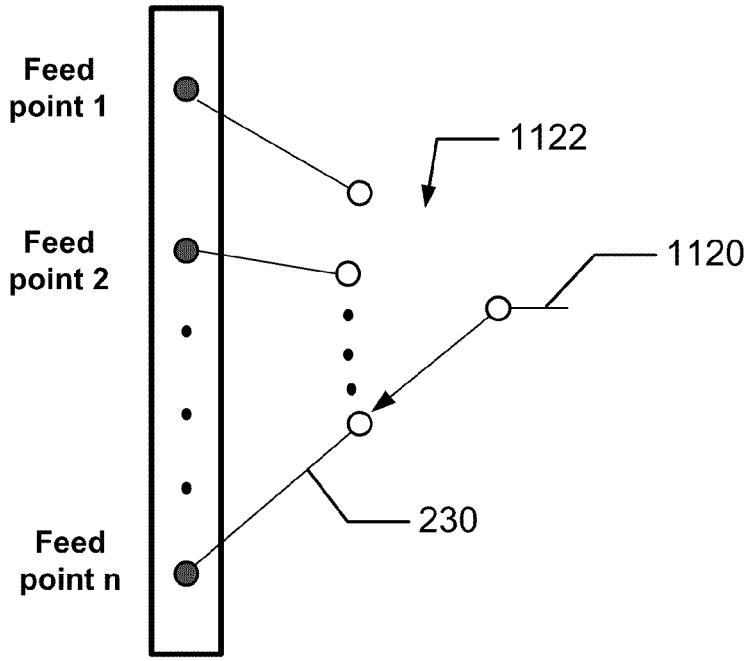

In another example, the switching means and amplitude adjustment means may be implemented using a number of feeds 230 coupled to the primary antenna feed 1120 through one or more switching devices 1122. This concept is illustrated in FIG. 11B. Multiple feed points may be located at discrete positions along the length of the antenna surface 100. Each feed point may be excited by coupling the feed point to the primary antenna feed 1120 when it is selected by a switching device 1122. Multiple feed points may be excited simultaneously using a multi-contact switching device 1122, or multiple switching devices 1122. Selecting feed points for excitation using a switching device 1122 adjusts the amplitude and/or phase of a single antenna 200, or multiple constituent antennas 200 depending on the feed points selected. In alternate embodiments, switching devices 1122 may be implemented by mechanical means, electrical/electronic means, digital means, optical means, software means, or the like.

Aperture Channel

The height of an aperture channel 224 of a spiraling surface antenna 200 can be reduced to simplify the fabrication and/or assembly of the antenna 200. The performance of the antenna 200 may change as the channel 224 is shortened in height. This is discussed above in relation to the cross-section of the spiraling surface 100, and applies here as well.

The upper aperture wall 246 of a spiraling surface 100 may be removed, as shown by the embodiment illustrated in FIG. 7B, with little to no appreciable performance change. Reducing the channel 224 more by shortening the height of the side aperture wall 776 reduces the gain of radiated energy. Reducing the height of the wall 776 by about 20% reduces the gain approximately 1 dB. A 40% reduction in the wall 776 height reduces the gain approximately 2.5 dB.

A dielectric block (not shown) may be positioned at a transmission feed point as a simple method to tune an antenna 200 for low return loss. A block used for this purpose may be sized at 0.21λ to 0.62λ long, and may generally be centered at the transmission feed point. The dielectric block may be sized to be as wide as the aperture channel 224 including clearance for a feed pin, and sized to be as high as the aperture wall 246. Polystyrene and other materials may have desirable RF properties suitable for this use.

Mechanical Considerations

A spiraling surface 100 to be used in constructing a spiraling surface antenna 200 may be fabricated, for example, out of sheet metal, conductive coated plastic, flexible copper clad Mylar sheet, copper clad laminates, or any conductive material that can be made to hold a rigid form and be robust enough to withstand handling. The spiraling surface 100 may be formed by rolling the surface 100 around a form, by extrusion, by machining, or other methods to produce the spiraling shape desired.

Figure 12A:
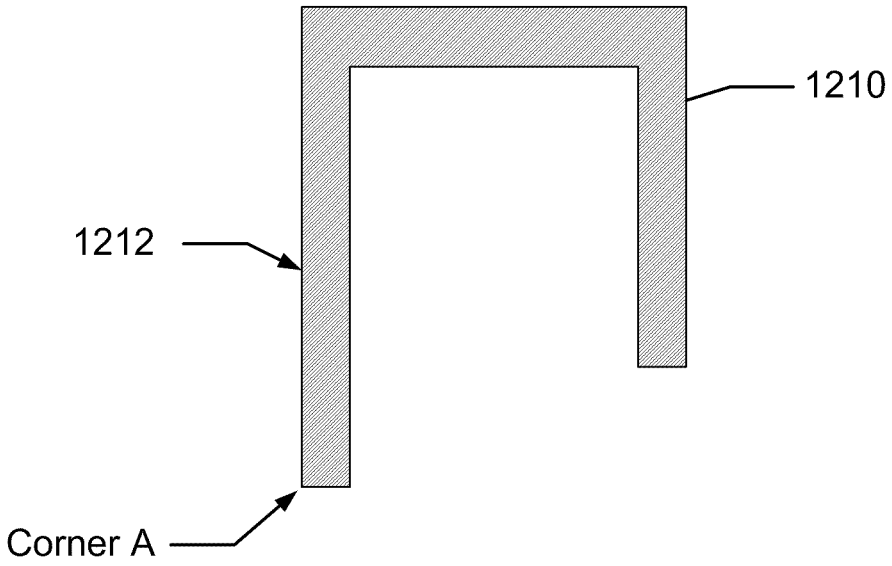
FIGS. 12A and 12B illustrate two sections for constructing an example spiraling surface antenna by coupling two spiraling surface assembly portions.
Figure 12B:
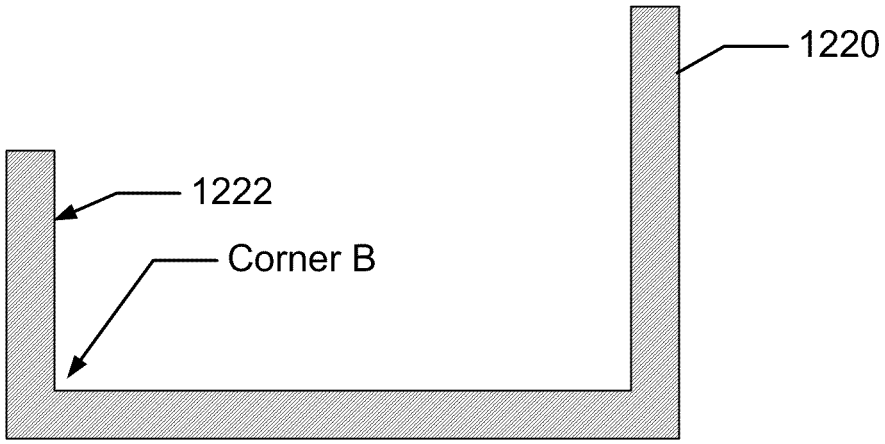

Commercially available materials including tubing, channels, and angle stock can be utilized to construct a spiraling surface 100 form factor. In one embodiment, a spiraling surface 100 may be constructed by coupling at least two formed parts (1210 and 1220) as shown in FIGS. 12A and 12B. This example illustrates a method of configuring available tubing, channels, and/or angle stock into a spiraling surface 100. The two channels shown have been formed with the proper dimensions so that the part 1210 shown in FIG. 12A can be fitted into the part 1220 shown in FIG. 12B. Assembly is simple, in that corner A of part 1210 is matched to the inside corner B of part 1220, such that the cavity wall 1212 and cavity-mating wall 1222 are flush. Parts 1210 and 1220 are then affixed to each other to form a solid spiraling surface 100. Parts 1210 and 1220 may be formed by any suitable method including machining, extrusion, molding, bending and the like.

Sheet metal may also be used to construct a spiraling surface 100. Depending on the number of bends there are in the design, the sheet metal may be shaped into a spiraling surface 100 using a brake, stamping, progressive dies or rolling.

Extruding metal can be a very cost-effective way of fabricating spiraling surfaces 100. Some advantages of this method include that the part may be extruded with all the required dimensions of a spiraling surface design 100. The extruded metal may be formed in long lengths, so that whatever length the design requires can simply be cut from the raw stock.

Figure 13A:
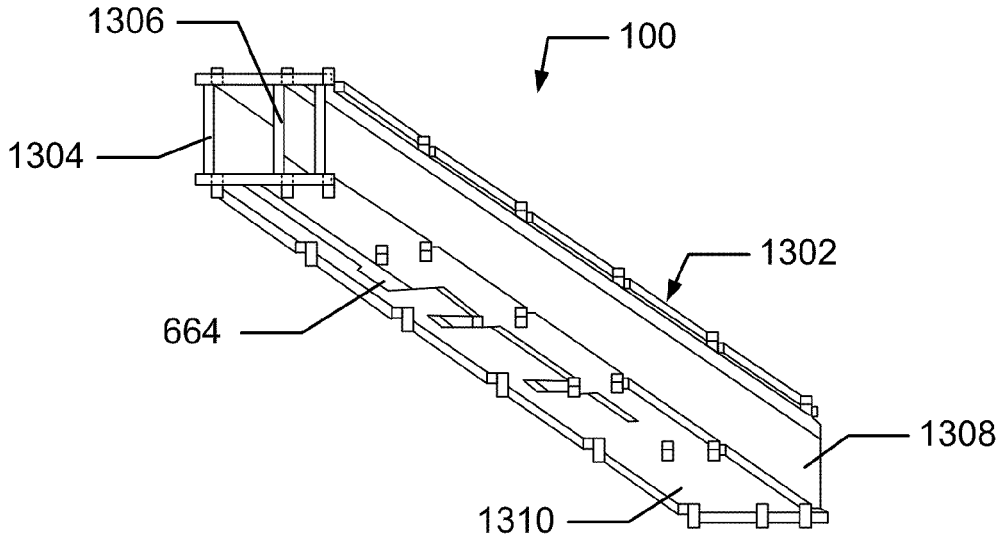
FIGS. 13A and 13B illustrate constructing an example spiraling surface antenna by coupling several PCB assembly portions in a spiraling configuration.
Figure 13B:
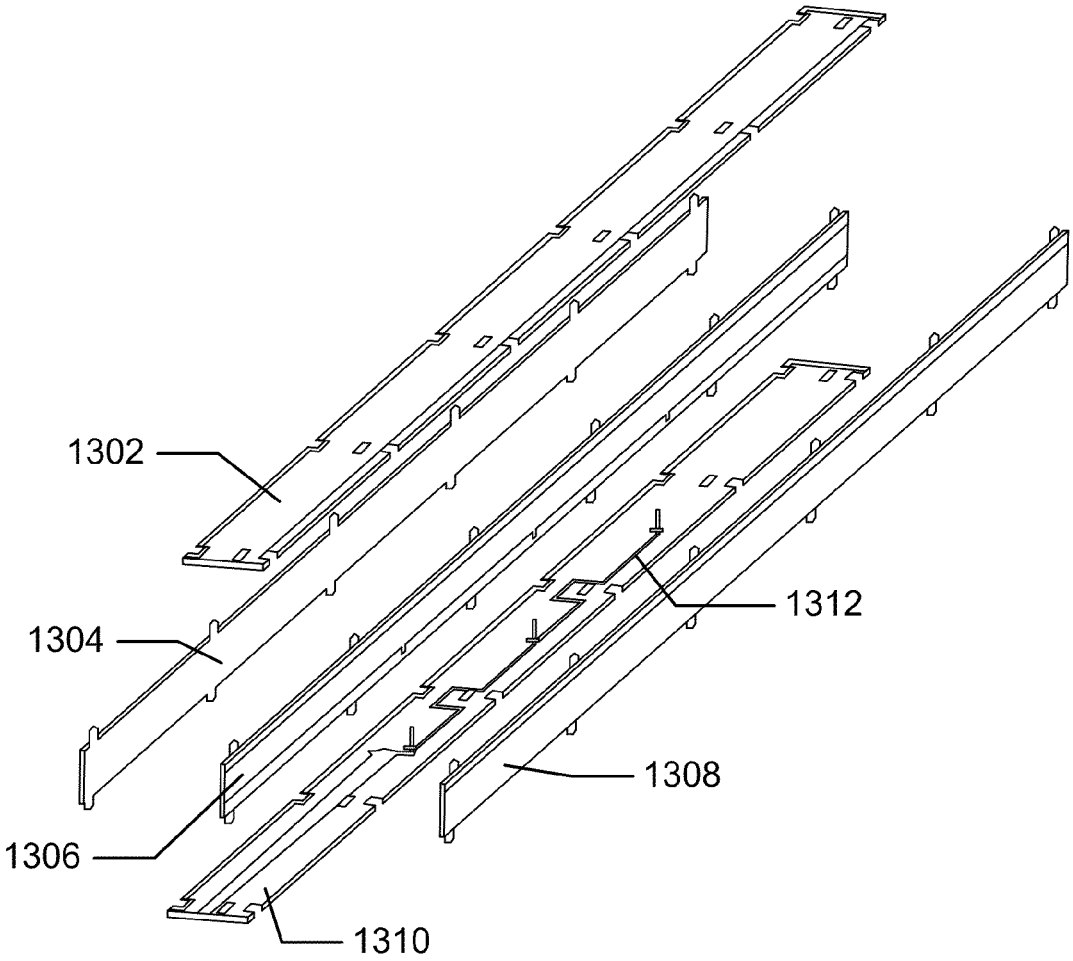
Figure 14A:
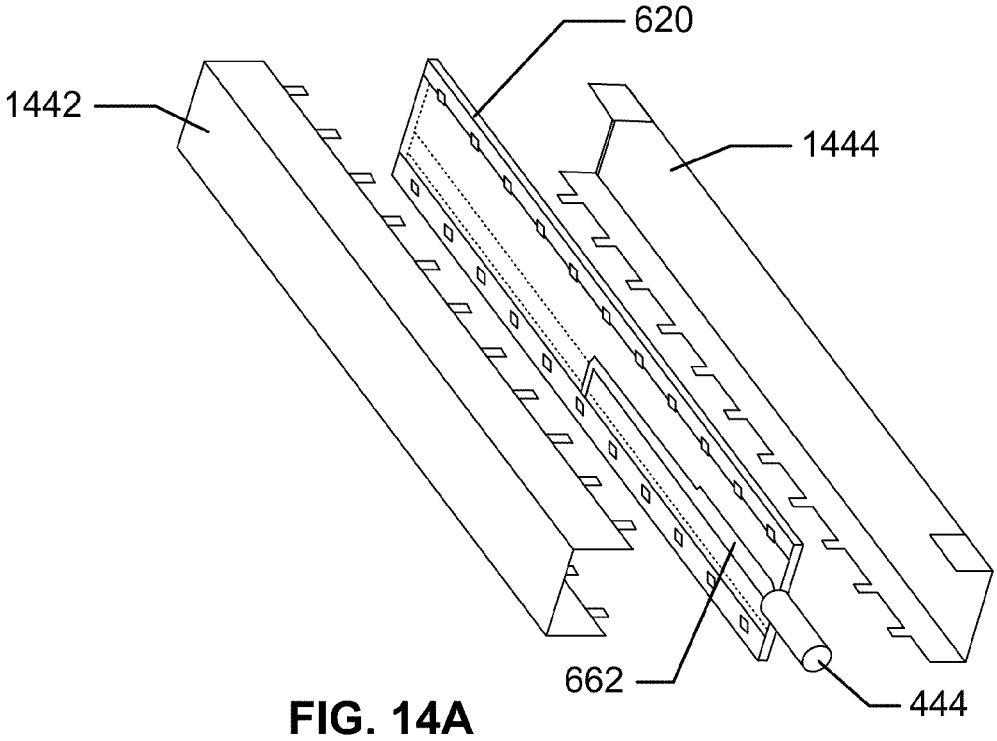
FIGS. 14A and 14B illustrate two views of constructing an example spiraling surface antenna by coupling two spiraling surface assembly portions with a single PCB as a mid wall.
Figure 14B:
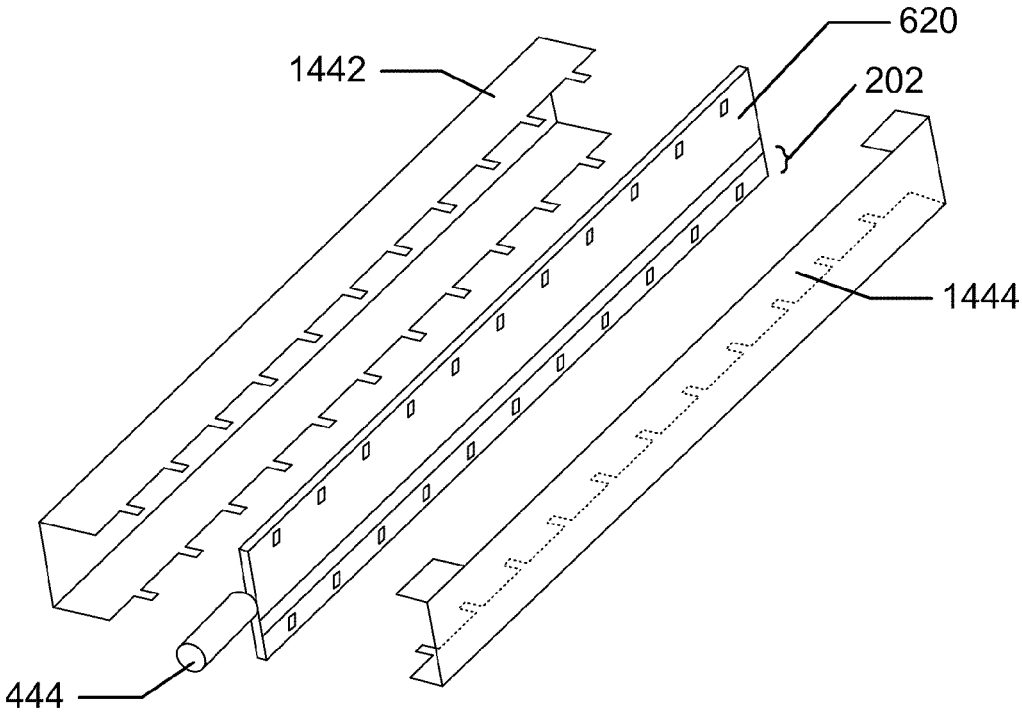
Figure 15A:
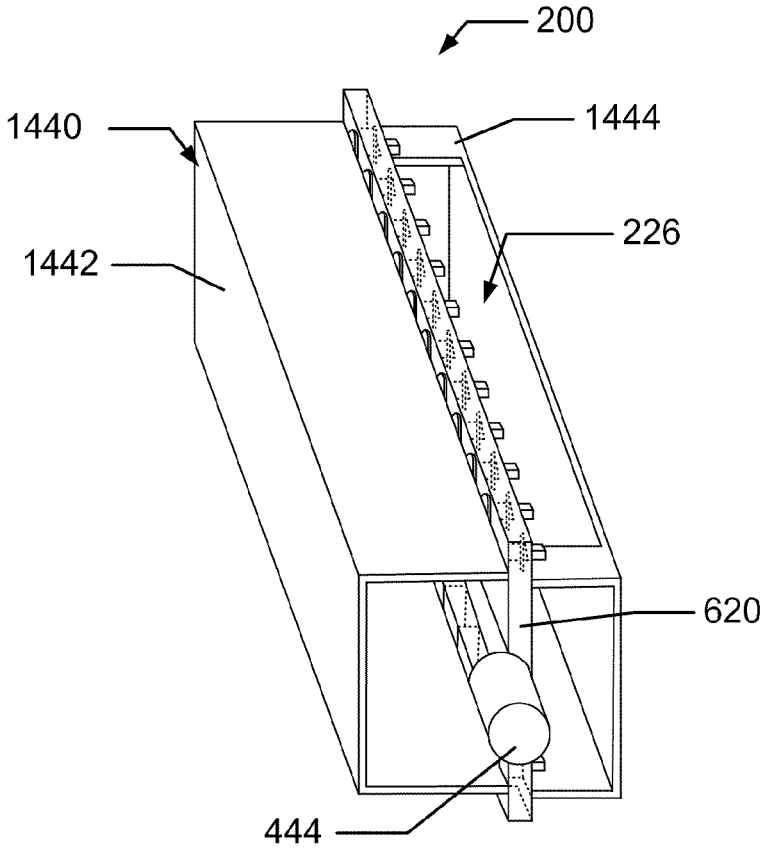
FIGS. 15A and 15B illustrate two views of the completed spiraling surface antenna of FIGS. 14A and 14B, constructed by coupling two spiraling surface assembly portions with a single PCB as a mid wall.
Figure 15B:
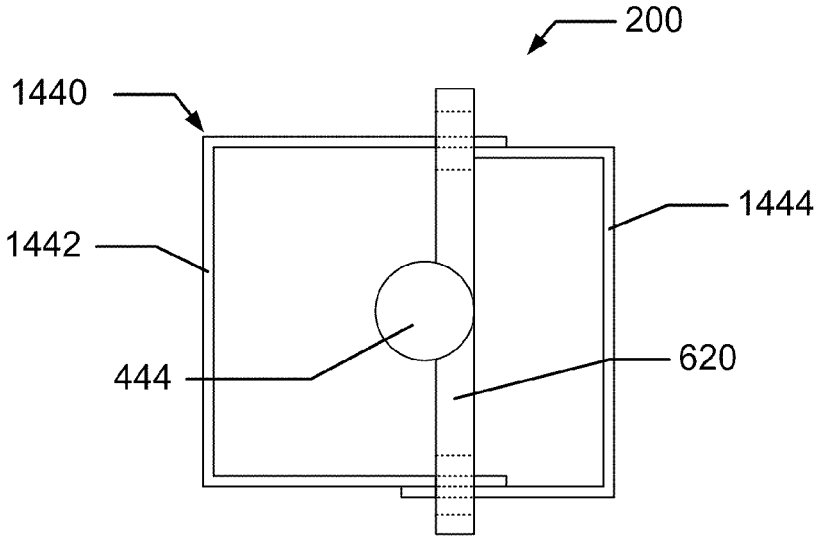

A spiraling surface 100 can also be fabricated from etched copper-clad substrates (printed circuit boards). One advantage of this method is the tight tolerances that can result from the etching process. Etched copper-clad boards may have tabs and notches fabricated into them as shown in FIGS. 13A and 13B, so that each board is held accurately in place during assembly. The use of copper cladding is an example only, and other conductive cladding (such as gold, silver, aluminum, and the like) may also be used on substrates for this purpose.

In one embodiment, shown in FIGS. 13A and 13B, etched boards including a top wall 1302, a cavity wall 1304, a mid wall 1306, an aperture side wall 1308, and a bottom wall 1310 may be coupled together to form a spiraling surface 100. In alternate embodiments, one or more of the walls may be omitted to form the spiraling surface 100. In further alternate embodiments, one or more additional walls may be added to form the spiraling surface 100.

In an example embodiment shown in FIGS. 13A and 13B, the bottom wall 1310 comprises a microstrip line 1312 and one or more antenna feeds. In alternate embodiments, a microstrip line 1312 may be included on one or more of the etched boards comprising the spiraling surface 100. The combination of the spiraling surface 100 comprised of etched boards and the microstrip line/feeds may comprise an example spiraling surface antenna 200.

Plastics can be molded or extruded into a spiraling surface 100 shape. The walls of a plastic spiraling surface 100, however, must be selectively coated with conductive material for use as an antenna 200.

For example, flexible copper-clad Mylar is ideal for imbedding within a dielectric material. A feed line 664 and the structure of a spiraling surface 100 can be etched on the Mylar sheet. The sheet may then be wrapped around a form, and the entire assembly may be over molded with dielectric material, becoming a solid structure in the form of a spiraling surface 100.

In a further embodiment of a spiraling surface antenna 200, a PCB 620 may be partially or fully encased in a conductive enclosure 1440 as shown in FIGS. 14A, 14B, 15A and 15B. The enclosure 1440 may be chemically etched and folded or stamped from thin metal sheets and may utilize tabs around its perimeter for mounting to the PCB 620. In one embodiment, the RF enclosure 1440 is comprised of a cavity can 1442, and an aperture can 1444. The aperture can 1444 may include a physical aperture 226 to allow RF energy access through the enclosure 1440. The cavity can 1442 and the aperture can 1444 may be coupled to the PCB 620 and/or to each other to form a spiraling surface antenna 200.

Conclusion

Although the invention has been described in language specific to structural features and/or methodological acts, it is to be understood that the invention defined in the appended claims is not necessarily limited to the specific features or acts described. Rather, the specific features and acts are disclosed as exemplary forms of implementing the claimed invention.

Additionally, while various discreet embodiments have been described throughout, the individual features of the various embodiments may be combined to form other embodiments not specifically described. The embodiments formed by combining the features of described embodiments are also spiral surface antennas.

What is claimed is:

1. A substantially omni-directional antenna for wireless electromagnetic communications, the antenna comprising:

an electrically conductive surface shaped to have a spiraling cross-section, the surface forming an internal cavity, the surface forming an internal channel to an external surface, the surface forming an internal wall common to the internal cavity and the internal channel, the internal wall having a longitudinal length and a longitudinal opening configured to allow radio frequency (RF) energy access to the internal channel and a width of the internal cavity being greater than a width of the internal channel such that in a plane perpendicular to the longitudinal length, the antenna is omni-directional with a maximum to minimum qain variation within a specified delta value and is polarized parallel to the plane; and an electrically conductive feed positioned to feed the antenna at the internal wall, the feed and the longitudinal opening being electrically coupled to induce an electric field along the longitudinal opening, the antenna being configured to transceive a wireless signal polarized parallel to the plane.

2. The antenna as recited in claim 1, wherein the feed and the longitudinal opening are electrically coupled to each other via at least one of a conductive contact, an inductive coupling, or a capacitive coupling.

3. The antenna as recited in claim 1, wherein the cross-sectional shape of the surface is selected from a group of cross-sectional shapes consisting of a substantially rectangular shape, a substantially circular shape, a substantially elliptical shape and a substantially polygonal shape.

4. The antenna as recited in claim 3, wherein the cross-sectional shape of the surface is discontinuous along a length of the surface.

5. The antenna as recited in claim 1, wherein a length of the antenna is configured based at least in part on a wavelength of the wireless signal to be transceived by the antenna, the antenna further comprising a radome that at least partially surrounds the antenna, the radome having a cross-sectional shape, the cross-sectional shape being a substantially circular shape, a substantially elliptical shape, a substantially polygonal shape, or a substantially rectangular shape, wherein the radome includes a structural radome or a non-structural radome, and wherein a smallest dimension of the cross-sectional shape of the structural radome is less than 0.194 times the wavelength of the wireless signal to be transceived by the antenna, and wherein a smallest dimension of the cross-sectional shape of the non-structural radome is less than 0.099 times the wavelength of the wireless signal to be tranceived by the antenna.

6. The antenna as recited in claim 1, wherein a length of the antenna is proportional to the signal gain of the antenna.

7. The antenna as recited in claim 1, wherein the maximum to minimum gain variation is less than or equal to the delta value of 3 decibels (dB).

8. A substantially omni-directional antenna for wireless electromagnetic communications, the antenna comprising:

a surface shaped to have a spiraling cross-section, the surface forming an internal cavity, the surface forming an internal channel to an external surface, the surface forming an internal wall common to the internal cavity and the internal channel, the internal wall having a longitudinal length and a longitudinal opening configured to allow radio frequency (RF) energy access to the internal channel, the surface having a cross-sectional shape, a width of the internal cavity being greater than a width of the internal channel such that in a plane perpendicular to the longitudinal length, the antenna is omni-directional with a maximum to minimum gain variation within a pre-specified delta value and polarized parallel to the plane, a length of the antenna is based at least in part on a wavelength of a wireless signal configured to be transceived by the antenna; and an electrically conductive feed line positioned to feed the antenna at the internal wall, the feed line having a feed, the feed and the longitudinal opening being electrically coupled to induce an electric field along the longitudinal opening, the feed and the longitudinal opening being electrically coupled to each other via at least one of a conductive contact, an inductive coupling, or a capacitive coupling, the antenna being configured to transceive wireless signal polarized parallel to the plane.

9. The antenna as recited in claim 8, wherein the antenna is configured for use over multiple wavelengths, and wherein the length of the antenna is proportional to the signal gain of the antenna.

10. The antenna as recited in claim 8, wherein the antenna is configured for use over multiple wavelengths, the antenna further comprising a plurality of feeds, the plurality of feeds and the longitudinal opening being electrically coupled to induce a plurality of electric fields along the longitudinal opening, wherein a phase relationship of the plurality of electric fields is based at least in part on locations of the plurality of feeds, and wherein the length of the antenna is proportional to the signal gain of the antenna.

11. An antenna array comprising a plurality of the antennas of claim 9, wherein each of the plurality of the antennas have one or more feeds, the one or more feeds producing a desired phase relationship between each of the plurality of the antennas.

12. The antenna as recited in claim 8, wherein when an axis along the length of the antenna is positioned vertically, the antenna is configured to emanate in a plane perpendicular to the longitudinal length, with the maximum to minimum gain variation less than or equal to 3 decibels (dB).

13. A substantially omni-directional antenna for wireless electromagnetic communications, the antenna comprising:

an electrically conductive surface having a spiraling cross-section, the surface forming an internal cavity, the surface forming an internal channel to an external surface, the surface forming an internal wall common to the internal cavity and the internal channel, the internal wall having a longitudinal length and a longitudinal opening configured to allow radio frequency (RF) energy access to the internal channel, the internal cavity having a width that is greater than a width of the internal channel such that in a plane perpendicular to the longitudinal length, the antenna is omni-directional with a maximum to minimum gain variation within a specified delta value and polarized parallel to the plane, the surface having a cross-sectional shape and a length of the antenna determines a signal gain of the antenna, wherein the antenna is configured to transceive a wireless signal polarized parallel to the plane;

an electrically conductive feed line positioned to feed the antenna at the internal wall, the feed line having a feed, the feed and the longitudinal opening being electrically coupled to induce a substantially omni-directional electric field perpendicular to the longitudinal opening when the antenna is energized;

the feed and the longitudinal opening being electrically coupled to each other via at least one of a conductive contact, an inductive coupling, or a capacitive coupling; and a radome that at least partially surrounds the antenna.

14. The antenna as recited in claim 13, wherein the feed is located at a selected point on the internal wall between a top of the antenna and a midpoint of the antenna, the selected point resulting in a downward tilt of the wireless signal.

15. The antenna as recited in claim 13, wherein the feed is located at a selected point on the internal wall between a midpoint of the antenna and a bottom of the antenna, the selected point resulting in an upward tilt of the wireless signal.

16. The antenna as recited in claim 13, further comprising one or more feeds, wherein the one or more feeds are configured to be adjustable to adjust at least one of an amplitude or a phase of an electric field induced in the antenna.

17. The antenna as recited in claim 16, further comprising a sliding device, wherein the sliding device is coupled to the one or more feeds and the sliding device is guided along the surface, the sliding device being configured to adjust a position of the one or more feeds.

18. The antenna as recited in claim 16, wherein the feed line includes one or more switching means, the one or more switching means being coupled to the one or more feeds, the one or more feeds located at selected locations on the antenna to control a radiation pattern emitted by the antenna.

19. The antenna as recited in claim 16, wherein the feed line includes one or more switching means, the one or more switching means being coupled to the one or more feeds to produce a desired radiation pattern at least in part by activating the one or more switching means.

20. A substantially omni-directional antenna for wireless electromagnetic communications, the antenna comprising:

an electrically conductive surface having a spiraling cross-section with a cross-sectional dimension, the surface forming an internal cavity, the surface forming an internal channel to an external surface, the surface forming an internal wall common to the internal cavity and the internal channel, the internal wall having a longitudinal length and a longitudinal opening configured to allow radio frequency (RF) energy access to the internal cavity, wherein the cross-sectional dimension is configured to cause a wireless signal to be transmitted by the antenna in a plane perpendicular to the longitudinal length, wherein the antenna is omni-directional with a maximum to minimum gain variation of less than or equal to 3 decibels (dB) and polarized parallel to the plane;

an electrically conductive feed positioned to feed the antenna at the internal wall, the feed and the opening being electrically coupled; and a radome that at least partially surrounds the antenna, the radome having a cross-sectional shape, the cross-sectional shape of the radome being one or a combination of a substantially circular shape, a substantially elliptical shape, a substantially polygonal shape or a substantially rectangular shape, wherein the radome is a structural radome or a non-structural radome, and wherein a smallest dimension of the cross-sectional shape of the structural radome is less than 0.194 times the wavelength of the wireless signal being transceived by the antenna, and wherein a smallest dimension of the cross-sectional shape of the non-structural radome is less than 0.099 times the wavelength of the wireless signal being transceived by the antenna.

* * * * *